US006079393A

United States Patent [19]

Tsutsumi et al.

[11] Patent Number: 6,079,393

[45] Date of Patent: Jun. 27, 2000

[54] FUEL VAPOR CONTROL SYSTEM OF AN INTERNAL COMBUSTION ENGINE

[75] Inventors: Kojiro Tsutsumi; Katsushi Watanabe, both of Wako, Japan

[73] Assignee: Honda Giken Kogyo Kabushiki Kaisha, Tokyo, Japan

[21] Appl. No.: 09/136,923

[22] Filed: Aug. 21, 1998

[30] Foreign Application Priority Data

Aug. 22, 1997 [JP] Japan ..... 9-241800

[51] Int. Cl.[7] ..... F02M 51/00

[52] U.S. Cl. ..... 123/478; 123/674

[58] Field of Search ..... 123/478, 480, 123/674

[56] References Cited

U.S. PATENT DOCUMENTS

| | | | |
|---|---|---|---|
| 5,758,308 | 5/1998 | Maki et al. | 123/478 |
| 5,896,845 | 4/1999 | Matsuda et al. | 123/478 |
| 5,908,463 | 6/1999 | Akazaki et al. | 123/480 |
| 5,931,143 | 8/1999 | Kitagawa et al. | 123/674 |

FOREIGN PATENT DOCUMENTS 6-026410 2/1994 Japan .

*Primary Examiner*—John Kwon

*Attorney, Agent, or Firm*—Arent Fox Kintner Plotkin & Kahn PLLC

[57] ABSTRACT

A system for controlling fuel vapors of an internal combustion engine having a fuel supply system including a fuel tank for supplying fuel to an air intake system such that an air-fuel mixture flows to a combustion chamber, including a canister purge mechanism for purging the stored fuel vapors into the air intake system of the engine through a purge line. A purged fuel amount supplied to the combustion chamber of the engine is calculated and a fuel injection amount to be supplied to the engine is determined based on the calculated purged fuel amount and a basic fuel inject-on amount. In the system, the purged fuel amount is calculated based on the estimated amount of the fuel vapors in response to a transport delay of the purged fuel vapors. The purged fuel amount is, on the other hand, calculated in response to the air/fuel ratio feedback correction coefficient and a learning control value ratio, thereby enhancing the accuracy in determining the correctional purged fuel amount and accordingly improving the accuracy in correcting the fuel injection amount by the determined correctional purged fuel amount.

16 Claims, 17 Drawing Sheets

FUEL VAPOR CONTROL SYSTEM OF AN INTERNAL COMBUSTION ENGINE

BACKGROUND OF THE INVENTION

1. Field of the Invention

The present invention relates to a fuel vapor control system of an internal combustion engine, and more particularly to a fuel vapor control system of an internal combustion engine which provides for accurate estimation of the fuel vapor amount purged or pulled from the charcoal of canister to the engine's air intake system and accurate correction of the fuel injection amount based on the estimated purged amount.

2. Description of the Related Art

It has been known to equip a charcoal canister in an internal combustion engine, filled with activated charcoal which absorbs and stores a large amount of fuel vapors leaving from a fuel tank through a vapor line (hose). The canister is connected to the engine air intake system (intake manifold) through a canister purge line (hose). When a purge solenoid valve equipped at the canister purge line is opened under predetermined engine operating conditions, the gasoline vapors stored in the canister charcoal bed are pulled into the air intake system and then into the combustion chamber for burning. Since the purged gasoline vapors disturb the engine air/fuel ratio control or fuel metering control, it has been desired to estimate the fuel vapor amount accurately and correct the fuel injection amount by the estimated amount.

Japanese Laid-open Patent Application No.6(1994)-26410 teaches calculating a current in-canister fuel vapor weight WC by subtracting a purged fuel vapor weight Fevpex from the in-canister fuel vapor weight calculated up to the last calculation cycle and by adding an in-canister-absorbed fuel vapor amount Fevpin. In the reference, the current in-canister fuel vapor weight WC thus calculated is then multiplied by a purge flow rate correction coefficient KQevp and another correction coefficient $\alpha$evp (determined based on an $O_2$ air/fuel ratio feedback correction coefficient $\alpha$) to determine a desorption factor KFevp.

In the reference, the desorption factor KFevp is then multiplied by a purge flow rate Qevp and a fuel specific weight $\gamma$evp to determine a purged fuel vapor weight Fevpex. The purged fuel vapor weight Fevpex is then multiplied by an injector correction coefficient Kinj to convert the same into a pulse-width correction coefficient (correctional purged fuel amount) Tevp. The pulse-width correction coefficient Tevp is then subtracted from a basic injection pulse-width (corresponding to a basic fuel injection amount). The difference is then multiplied by the $O_2$ air/fuel ratio feedback correction coefficient $\alpha$ and similar parameters to finally determine an output injection pulse width (corresponding to an output or final fuel injection amount) Ti.

In the prior art, although the fuel injection amount is corrected using the correctional purged fuel amount currently calculated, the transport delay of the purged fuel vapors is not taken into account or considered in the fuel injection amount correction. In other words, the transport delay of the purged fuel vapors are not compensated in the prior art. Thus, the prior art is disadvantageous in that the accuracy in determining the purged fuel amount is not always satisfactory and hence, the accuracy in correcting the fuel injection amount is not always satisfactory.

BRIEF SUMMARY OF THE INVENTION

An object of the invention is therefore to solve the problem in the prior art and to provide a fuel vapor control system of an internal combustion engine which can compensate for the transport delay of the purged fuel vapors, thereby enhancing the accuracy in determining the correctional purged fuel amount and accordingly improving the accuracy in correcting the fuel injection amount based on the determined correctional purged fuel amount.

Moreover, in the reference, the desorption factor KFevp is calculated using the correction coefficient $\alpha$evp (determined from the $O_2$ air/fuel ratio feedback correction coefficient) and, based on the factor, the correctional fuel vapor amount for canister purge Tevp is calculated. If the detected air/fuel ratio involves; an error inherent to the engine due to aging of the air/fuel ratio sensory system, for example, and irrelevant to the canister purging, the correctional purged fuel amount calculated on the basis of the detected air/fuel ratio will not always be satisfactory in accuracy.

Another object of the invention is therefore to solve the problem in the prior art and to provide a fuel vapor control system of an internal combustion engine which can accurately determine the correctional purged fuel amount even when the detected air/fuel ratio involves an error inherent to the engine, thereby enhancing the accuracy in determining the correctional purged fuel amount and accordingly improving the accuracy in correcting the fuel injection amount by the determined correctional purged fuel amount.

In order to achieve the object, there is provided a system for controlling fuel vapors of an internal combustion engine having a fuel supply system including a fuel tank for supplying fuel to an air intake system such that an air-fuel mixture flows to a combustion chamber, comprising fuel vapor storing means for storing fuel vapors vaporized in the fuel supply system; purge means for purging the stored fuel vapors into the air intake system of the engine through a purge line; a valve provided in the purge line for opening or closing the purge line; fuel vapor amount estimating means for estimating an amount of the fuel vapors stored in the fuel vapor storing means; flow rate calculating means for calculating a flow rate of fuel vapors purged to the air intake system through the valve; purged fuel amount calculating means for calculating a purged fuel amount supplied to the intake system of the engine; basic fuel injection amount calculating means for calculating a basic fuel injection amount in response to detected engine operating parameters; fuel injection amount calculating means for calculating a fuel injection amount to be supplied to the engine based on the calculated purged fuel amount and the basic fuel injection amount; and an injector for injecting fuel into the air intake system in response to the calculated fuel injection amount; wherein said purged fuel amount calculating means calculates the purged fuel amount based on the estimated amount of the fuel vapors in response to a transport delay of the purged fuel vapors.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Embodiments of the invention will now be explained with reference to the drawings.

Figure 1:
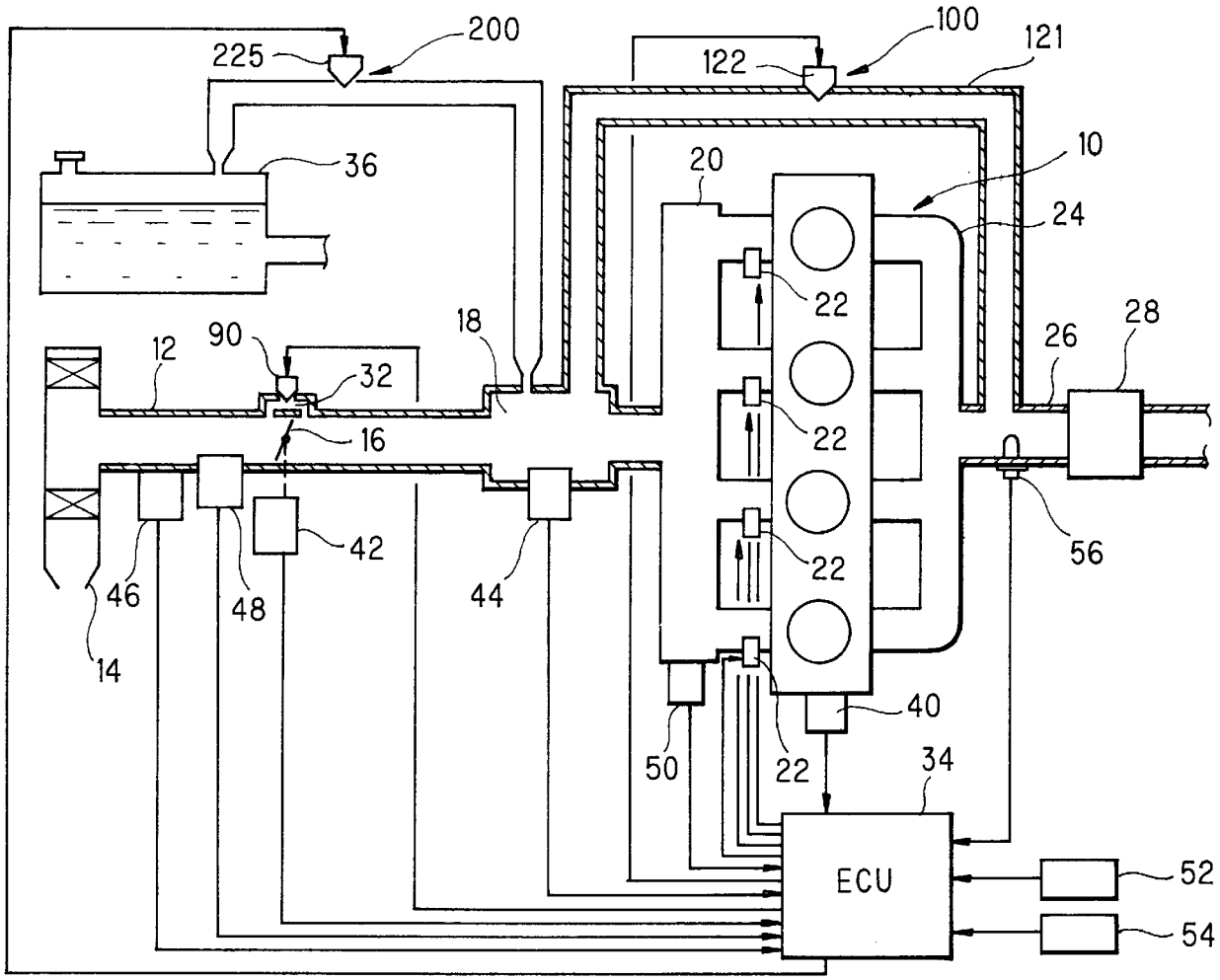
FIG. 1 is an overall schematic view showing a fuel vapor control system of an internal combustion engine according to the present invention.

FIG. 1 is an overall schematic view of a fuel vapor control of an internal combustion engine according to the invention.

Reference numeral 10 in this figure designates an overhead cam (OHC) in-line four-cylinder (multi-cylinder) internal combustion engine. Air drawn into an air intake pipe (passage) 12, through an air cleaner 14 mounted on a far end thereof, is supplied to each of the first to fourth cylinders through a surge tank 18, an intake manifold 20 and two intake valves (not shown), while the flow of the air is adjusted by a throttle valve 16.

A fuel injector 22 is installed in the vicinity of two intake valves (not shown) of each cylinder and is for injecting or supplying fuel before the intake valves. The injected fuel mixes with the intake air to form an air-fuel mixture that enter the combustion chamber (not shown) in the associated cylinder and is ignited by a spark plug (not shown) in the firing order of #1, #3, #4 and #2 cylinder. The resulting combustion of the air-fuel mixture drives a piston (not shown) down.

The exhaust gas produced by the combustion is discharged through two exhaust valves (not shown) into an exhaust manifold 24, from where it passes through an exhaust pipe (passage) 26 to a catalyst (three-way catalytic converter) 28 where noxious components are removed therefrom before it is discharged to the exterior. The throttle valve 16 is bypassed by a bypass 32 provided at the air intake pipe 12 in the vicinity thereof. The engine 10 is equipped with an exhaust gas recirculation (EGR) mechanism 100.

Figure 2:
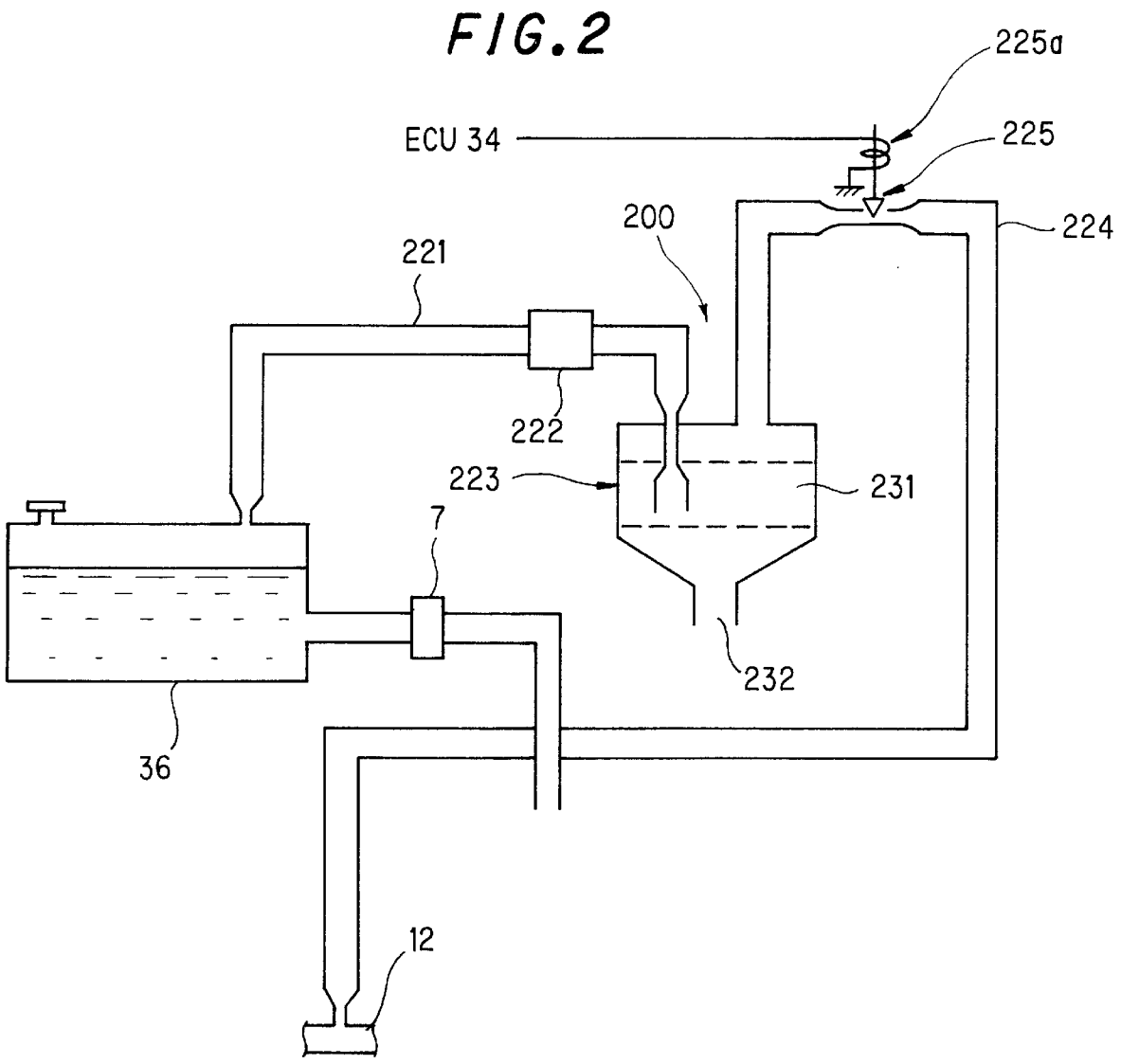
FIG. 2 is a partial schematic view showing the details of a canister purge mechanism shown in FIG. 1.

The engine 10 is also equipped with a canister purge mechanism 200 connected between the air intake system and a fuel tank 36. As seen in FIG. 2, the canister purge mechanism 200 is provided between the sealed fuel tank 36 and the air intake pipe 12 (or the intake manifold 20) downstream of the throttle valve 16, and includes a charcoal canister 223 containing an absorbent (the bed of activated charcoal) 231, a vapor supply hose (line) 221 connecting the top of the sealed fuel tank 36, And a canister purge hose (line) 224 connecting the canister 223 and the air intake pipe 12.

The vapor supply hose 221 is fitted with a two-way valve 222, and the canister purge hose 224 is fitted with a purge solenoid valve 225 made of an electromagnetic solenoid valve having a solenoid 225*a*. The solenoid 225*a* is connected to an electronic control (ECU) 34 and is duty-ratio controlled (PWM) by a command signal from the ECU 34 such that a desired degrees of valve opening is linearly achieved.

When the fuel vapors leaving the fuel tank 36 rise to a prescribed pressure, they push open the two-way valve 222 and enter the canister 223, where they are absorbed and stored in the bed of charcoal 231. The bottom of the canister has an air intake 232 and is open. When the purge solenoid valve 225 is controlled to open in response to the duty-ratio (dizzy ON/OFF signal) supplied from the ECU 34, the fuel vapors stored in the bed of charcoal are sucked into the air intake pipe 12 by the negative manifold pressure, together with air flowing through the bottom of the canister 223, and then flows to the cylinders.

When the fuel tank 36 is cooled by the ambient temperature and the in-tank pressure drops to increase the negative pressure, the negative valve of the two-way valve 222 opens to allow the vaporized fuel stored in the canister 223 to return to the fuel tank 36.

Returning to the explanation of FIG. 1, the engine 10 is provided at its camshaft (not shown) with a crank angle sensor 40 which generates a CYL signal for cylinder identification at a specific crank angle of a certain cylinder among the four cylinders, a TDC signal at a predetermined crank angle of each cylinder, and a CRK signal once per unit crank angle such as at 15 crank angle degrees.

The engine 10 is further provided with a throttle position sensor 42 which generates a signal indicative of the degree of opening of the throttle valve 16, and a manifold absolute pressure sensor 44 which generates a signal indicative of the manifold pressure PBA. In addition, the engine 10 is provided, at appropriate locations, with an atmospheric pressure sensor 46 which generates a signal indicative of atmospheric pressure PA and an intake air temperature sensor 48 which generates a signal indicative of the temperature of the intake air.

The engine is furthermore provided with a coolant temperature sensor 50 which generates a signal indicative of the engine coolant temperature TW, a battery voltage sensor 52 which generates a signal indicative of the voltage VB of a battery (not shown) mounted on the vehicle (not shown) on which the engine 10 is mounted, and a vehicle speed sensor 54 near the drive shaft (not shown) which generates a signal indicative of the travelling speed VP of the vehicle.

Moreover, the engine 10 has an $O_2$ sensor (air/fuel ratio sensor) 56 at the exhaust system at a position downstream of the confluence point of the exhaust manifold 24 and upstream of the catalyst 28, which generates a signal indicative of the oxygen concentration in the exhaust gas.

The outputs of the sensors are sent to the ECU 34. The ECU 34 has a microcomputer comprised of a CPU, a ROM, a RAM and other components. In the ECU 34, the CPU calculates manipulated variables as will be explained later in accordance with instructions stored in the ROM, and counts the CRK signals developed by the crank angle sensor 40 and the VP signals produced by the vehicle speed sensor 54 to detect the engine speed NE and vehicle speed VP.

The operation of the fuel vapor control system of an internal combustion engine according to the invention will now be explained.

In the system, an in-canister fuel vapor amount (concentration) VPRCAN absorbed in the canister 223 is estimated and, based on the estimated values and purge flow rate, a correctional purged fuel amount TiEVAP (corresponding to the injection amount of purged fuel vapors) is calculated.

The operation of the system will now be explained with reference to the flow chart shown in FIG. 3.

The program starts at S10 in which the engine parameters indicative of the operating condition of the engine such as the engine speed NE and the manifold absolute pressure PBA are read. The program then proceeds to S12 in which it is checked whether the engine 10 is cranking (starting), and if no, to S14 in which it is determined whether fuel cutoff is in progress. When the result is negative, the program proceeds to S16 in which a basic fuel injection amount TiM is retrieved from a mapped data using the engine speed NE and the manifold absolute pressure PBA as the address data.

The program next proceeds to S18 in which the fuel injection amount required by the engine TiREQ is calculated using the equation shown there (where, KTOTAL: the product of all correction to be made by multiplication (except for an air/fuel ratio feedback correction coefficient KAF explained later); TiIDLE: a correctional fuel injection amount under engine idling; and TiPRO: a correctional fuel injection amount for manufacturing variance).

The program next proceeds to S20 in which it is checked whether the $O_2$ sensor 56 is activated. When the result is affirmative, the program proceeds to S22 in which it is checked whether the engine operation is within the air/fuel feedback control region. When the result is affirmative, the program proceeds to S24 in which the air/fuel ratio feedback correction coefficient KAF is calculated based on the air/fuel ratio detected by the $O_2$ sensor 56 using a PI (proportional and integral) feedback gains. In accordance with a known manner.

The program proceeds to S26 in which the correctional purged fuel amount TiEVAP (explained later in detail) is calculated, to S28 in which the fuel injection amount to be supplied to the engine cylinders Tcyl is calculated using the equation shown there (where, TTOTAL: the sum of correction coefficients to be made by addition (except for the battery voltage correction coefficient TiVB). Thus, the fuel injection amount correction is carried out by subtracting TiEVAP from the calculated fuel injection amount.

The program then proceeds to S30 in which an output fuel injection Tout is calculated in the manner shown there, and to S32 in which the calculated fuel injection amount Tout is output to the fuel injector 22 through driver circuit (not shown). All of the values TiREQ, Tcyl, TiEVAP and Tout are determined or calculated in terms of opening (injection) time or period of the fuel injector 22.

When the result in S12 is affirmative, the program proceeds to S34 in which an injection amount Ticr is calculated in accordance with an equation for engine starting (not shown) and is used as the output injection amount Tout. When the result in S14 is affirmative, the program proceeds to S36 in which the output injection amount Tout is set to zero. When the result in S20 or S22 is negative, the program proceeds to S38 in which the air/fuel ratio feedback correction coefficient KAF is set to 1.0.

Figure 3:
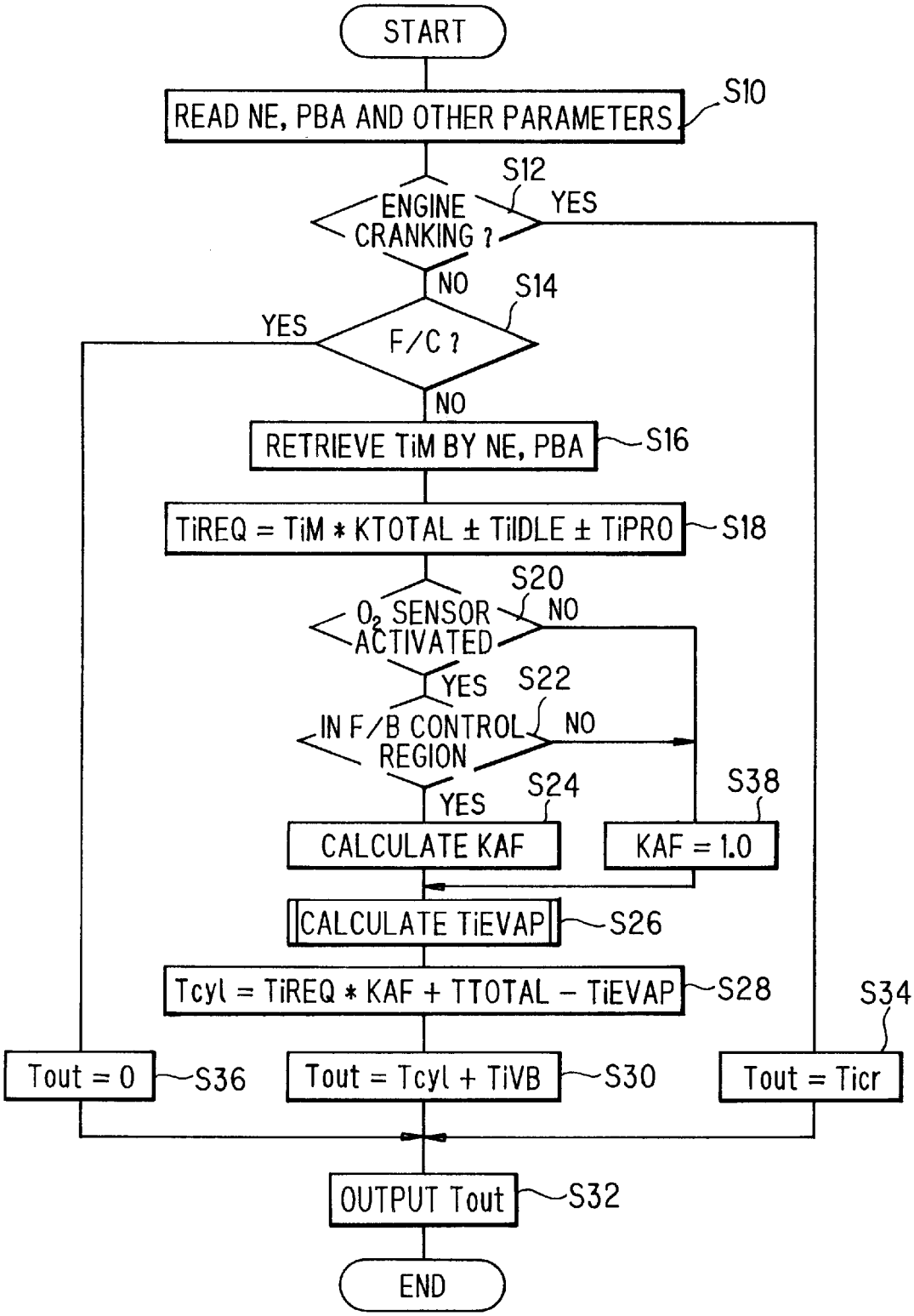
FIG. 3 is a flow chart showing the operation of the system, more specifically the fuel injection amount correction by a correctional purged fuel amount.
Figure 4:
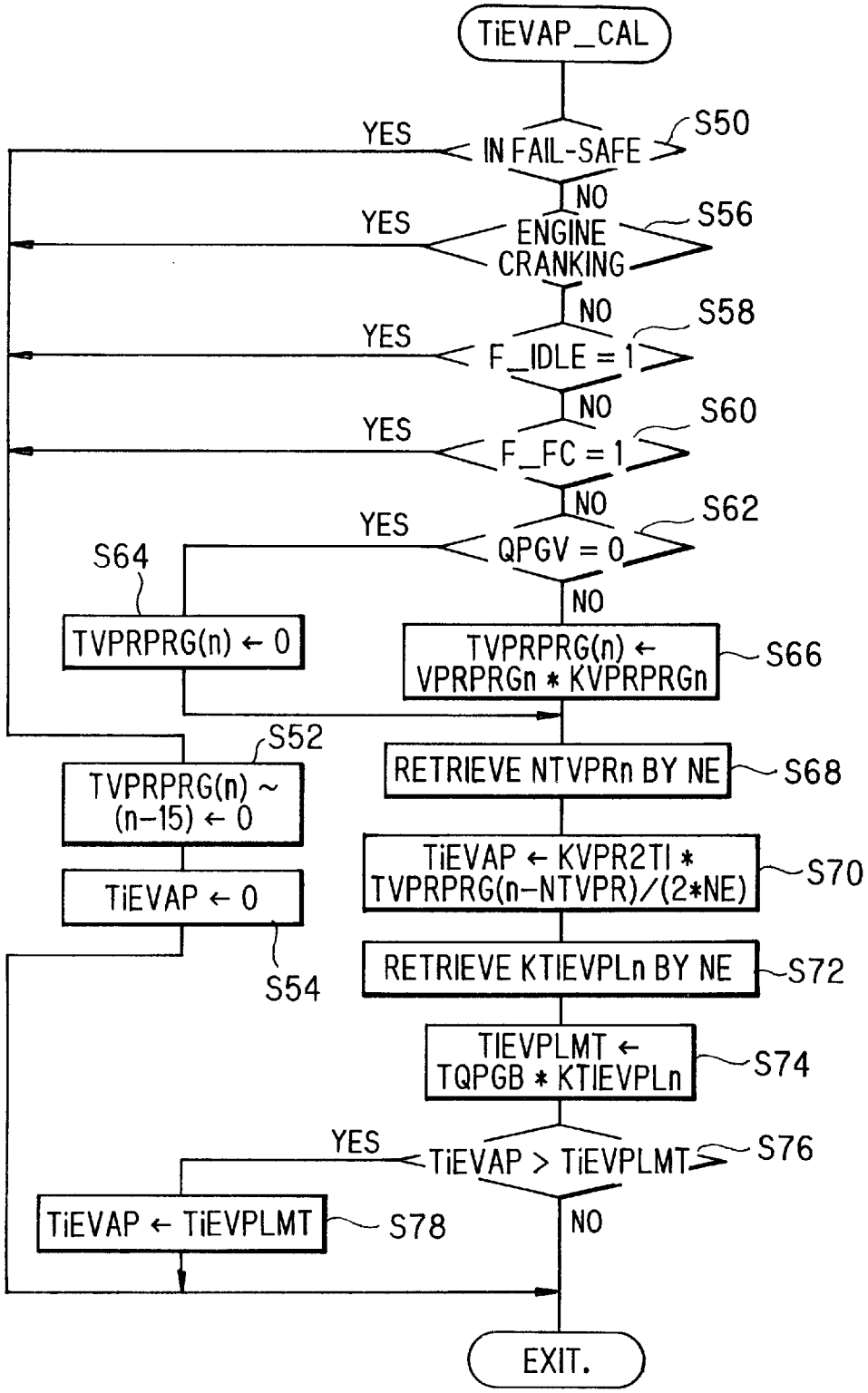
FIG. 4 is a flow chart showing the subroutine for calculating the correctional purged fuel amount referred to in the flow chart of FIG. 3.

FIG. 4 is a flow chart showing the subroutine for calculating the correctional purged fuel amount TiEVAP referred to in S26 of the flow chart of FIG. 3.

The program starts at S50 in which it is checked if any fail-safe process is in progress and if the result is affirmative, since this means that any failure has occurred in the system such as the $O_2$ sensor 56, the program proceeds to S52 in which values TVPRPRO(n) to TVPRPRG(n−15), explained later, are all set to 0, to S54 in which the aforesaid value TiEVAP is set to zero.

Here, the values TVPRPRG(n) to (n−15) are fuel vapor amount [g/min] supplied to the engine by the canister purge, in which (n) is a sample number of the discrete system, more specifically, the time or loop of the program shown in FIG. 3 is executed. Accordingly, a value added with (n) means a value determined at the current program loop (current control cycle), a value added with (n−m) means a value determined at the program loop m-times earlier (the control cycle m-times earlier). In the specification and figures, (n) is sometimes mentioned as n.

When the result in S50 is negative, the program proceeds to S56 in which it is checked whether the engine is cranking, and when the result is affirmative, since this means that the fuel injection amount is calculated using the equation for engine starting as explained above, the program proceeds to S52, S54.

When the result is negative, on the other hand, the program proceeds to S58 in which it is checked whether the bit of a flag F_IDLE is set to 1, more specifically it is checked whether the engine is idling. If the result is affirmative, since the air/fuel ratio become unstable if the fuel injection amount correction deviates from an appropriate value when the engine operation shifts from idling to the other states, the program proceeds to S52, S54.

When the result is negative, the program proceeds to S60 in which the bit of a flag F_FC is set to 1, in other words, it is checked whether the fuel cutoff is in progress. If the result is affirmative, the program proceeds to S52, S54 for a reason similar to that in the previous checks. If the result is negative, on the other hand, the program proceeds to S62 in which it is determined whether a value QPGV is zero. The value QPGV is the actual purge flow rate, which is calculated taking the performance characteristics of the purge solenoid valve 225.

When the result is affirmative in S62, since this means that no canister purge is in progress, the program proceeds to S64 in which the fuel vapor amount TVPRPRG(n) is set to zero. When the result is negative, on the other hand, the program proceeds to S66 in which the fuel vapor amount TVPRPRG (n) is calculated by multiplying a value VPRPRGn by a value KVPRPRGn. The value VPRPRGn is a (current) fuel vapor amount assuming that in-canister fuel vapors are purged at a predetermined flow rate, and the value KVPRPRGn is a correction coefficient for converting the predetermined flow rate into the actual flow rate. These values will be explained later.

Figure 5:
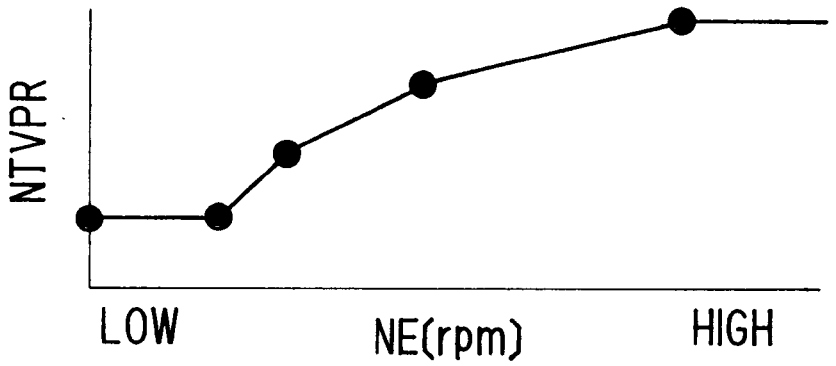
FIG. 5 is an explanatory graph showing the characteristics of a coefficient for compensating the transport delay of the fuel vapors referred to in the flow chart of FIG. 4.

The program then proceeds to S68 in which a value NTVPRn is retrieved from table data using the detected engine speed NE as the address datum. The value NTVPRn is a (current) value for compensating for the delay or lag (calculated in terms of a number of combustion cycles) before the purged fuel vapors enter the combustion chamber, more precisely the delay or lag before the purged fuel vapors contribute to combustion. The value NTVPRn is expressed in the number of TDCs. FIG. 5 shows the characteristics of the table data. The reason why the value NTVPR is set to increase with increasing engine speed is that the TDC intervals decrease with increasing engine speed so that the number of TDCs increases within a unit time.

The program proceeds to S70 in which the correctional purged fuel amount TiEVAP is calculated in accordance with the equation shown there. In the equation, KVPR2TI is a coefficient for converting TVPRPRGn [g/min] into an fuel amount [g]. The value is divided by (2×NE) in order to convert it into a value per injection. The engine 10 in the embodiment is a four-cylinder engine in which the injection takes place 2 times per crank shaft rotation. If the engine is six-cylinder engine, the divisor should be (3×NE).

Figure 6:
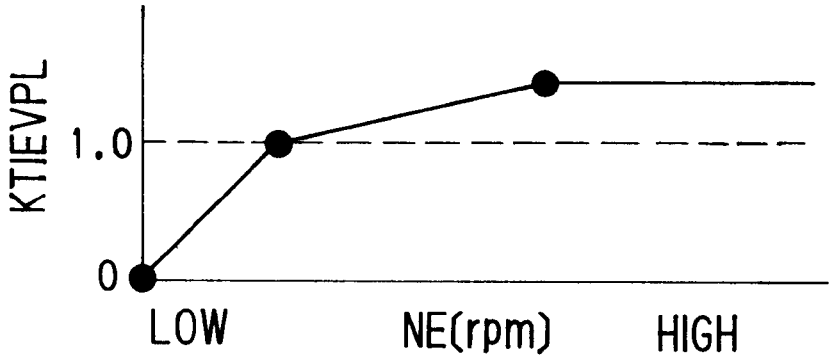
FIG. 6 is an explanatory graph showing the characteristics of a limitative correction coefficient referred to in the flow chart of FIG. 4.

The program proceeds to S72 in which a value KTIEVPLn is retrieved from table data using the detected engine speed NE as the address datum. The value KTIEVAPn is a (current) limitative correction coefficient. FIG. 6 illustrates the characteristics of the table data. Since the variance in the correctional fuel amount increases with decreasing engine speed, the value is set with respect to the engine speed.

The program proceeds to S74 in which a value TQPGB is multiplied by the retrieved KTIEVPLn to calculate a correction limit TIEVPLMT. The value TQPGB is a fuel vapor amount to be purged, more precisely a desired purged fuel amount in the fuel mixture to be supplied to the engine. The program then proceeds to S76 in which the correctional purged fuel amount TiEVAP is compared with the limit and if TiEVAP exceeds the limit, the program proceeds to S78 in which TiEVAP is replaced by the limit.

Next, the calculation of an in-canister fuel vapor amount (concentration) VPRCANI will be explained. The value is necessary for calculating the aforesaid value VPRPRGn which in turn is used for calculating the correctional purged fuel amount TiEVAP.

Figure 7:
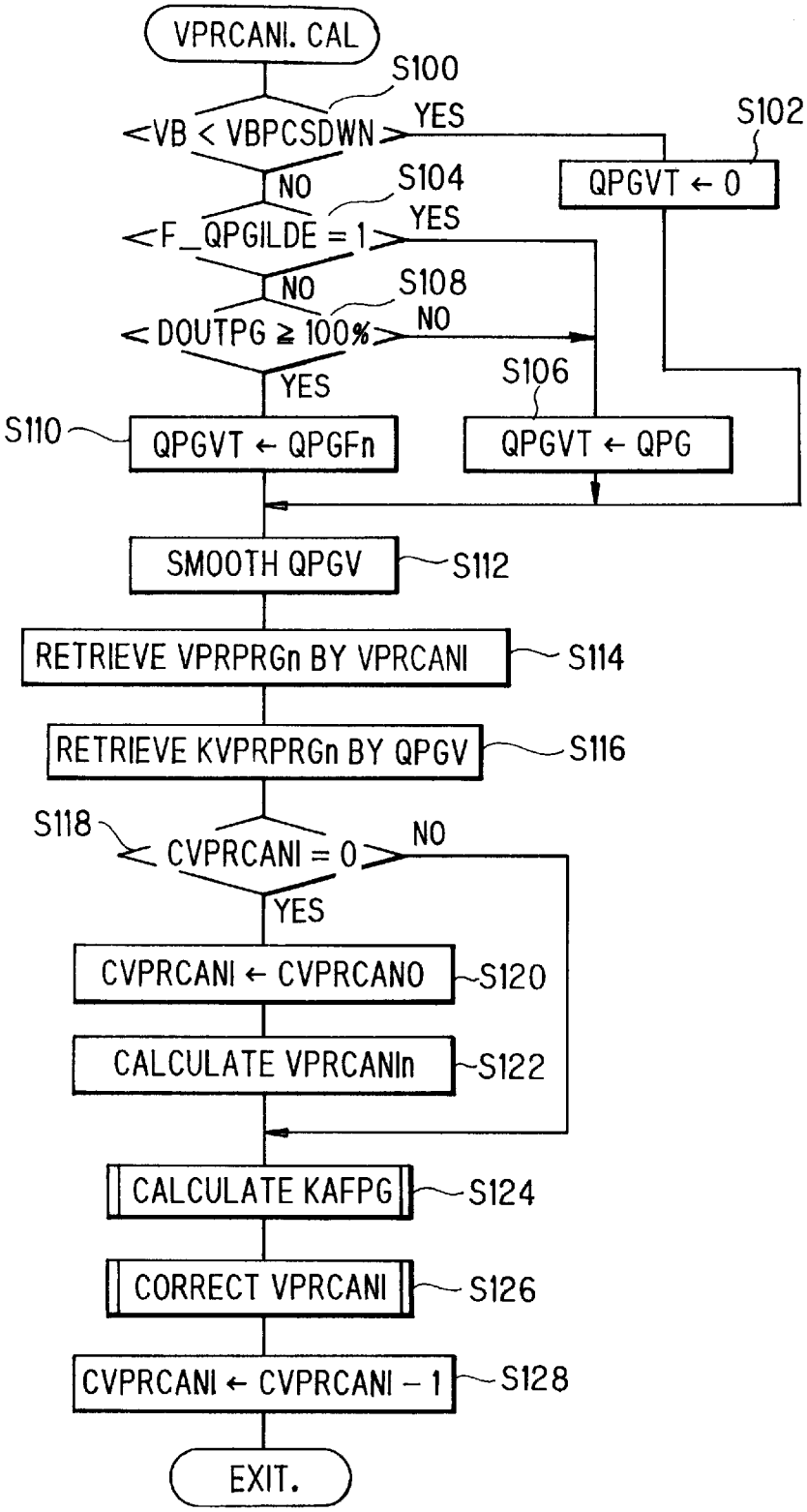
FIG. 7 is a flow chart showing the calculation or estimation of an incanister fuel vapor amount necessary for calculating the correctional purged fuel amount in the flow chart of FIG. 4.

FIG. 7 is a flow chart showing the calculation of the in-canister fuel vapor amount VPRCANI. The program disclosed in the figure is executed once every predetermined interval, such as 80 msec.

The program starts at S100 in which it is determined whether the detected battery voltage VB is less than a predetermined voltage VBPCSDWN. When the result is affirmative, since this means that the purge solenoid valve 225 might rot be operational, the program proceeds to S102 in which a value QPGVT is set to zero to discontinue the correction.

When the result is negative, on the other hand, the program proceeds to S104 in which it is checked whether the bit of a flag F_QPGIDLE is set to 1.

In this fuel vapor control system, when the purge flow rate is low such as during engine idling, since the operational variance of the purge solenoid valve 225 makes it difficult to control the flow rate of the purge solenoid valve 225, the valve 225 is therefore duty-ratio controlled. More specifically, the duty-ratio (duty-ratio in the PWM) to be supplied to the solenoid 225*a* of the valve 225 is controlled.

On the other hand, if the engine is under conditions where purge flow rate is relatively large, the valve is controlled such that its flow rate converges to a desired flow rate. To set the bit of the flag F_QPGIDLE to 1 indicates that the duty-ratio control should be carried out, while to reset the flag bit to 0 indicates that the flow rate control should be conducted.

When the result is affirmative in S104, the program proceeds to S106 in which the value QPGVT is determined to be a desired purge flow rate (explained later). When the result is negative in S104, the program proceeds to S108 in which it is determined whether the duty ratio DOUTPG to be supplied to the solenoid 225*a* is 100%. When the result is affirmative, the program proceeds to S110 in which QPGVT is set to its maximum value QPGFn in order that the flow rate should be within the ability o)f the purge solenoid valve 225. When the result is negative, the program proceeds to S106.

The program then proceeds to S112 in which an actual purge flow rate QPGV is smoothed, more specifically, is subject to the first-order lag, using the following equation.

$$QPGV = CQPGV \times QPGVT + (1 - CQPGV) \times QPCV(n-1)$$

Figure 8:
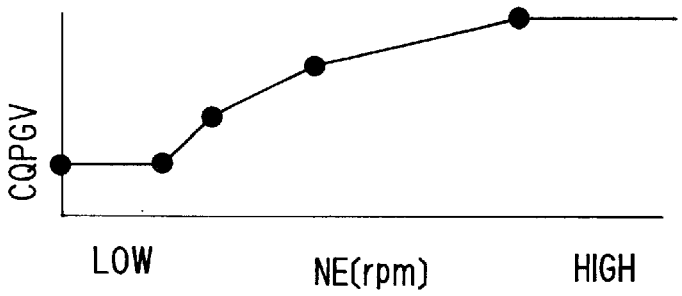
FIG. 8 is a explanatory graph showing the characteristics of a smoothing coefficient or weight in the weight-average calculation referred to in the flow chart of FIG. 7.

The value QPGV is an actual purge flow rate calculated taking the ability of the canister solenoid valve 225 in view. The purge flow rate has a delay due to the valve response lag and the inertia of the purged gas (fuel vapors). The delay is assumed to be the first-order lag, and using the weight (smoothing coefficient) CQPGV, the actual purge flow rate is subject to the weight-average. FIG. 8 shows the characteristics of the weight CQPGV. Since the TDC interval decreases with increasing engine speed, the weight is similarly set with respect to the engine speed.

Figure 9:
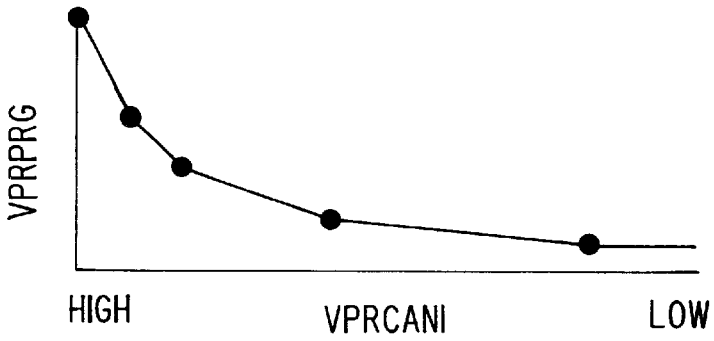
FIG. 9 is an explanatory graph showing the characteristics of a fuel vapor amount used in the calculation in the flow chart of FIG. 7.

The program then proceeds to S114 in which VPRPRGn is retrieved from table data using the in-canister fuel vapor amount (i.e., concentration) VPRCANI. As mentioned above, VPRCANI is an estimated value of the in-canister fuel vapor amount (concentration) stored in the canister, VPRPRGn is the (current) fuel vapor amount determined on the assumption that the stored fuel vapors are purged at a predetermined flow rate. FIG. 9 illustrates the characteristics of the table data.

Figure 10:
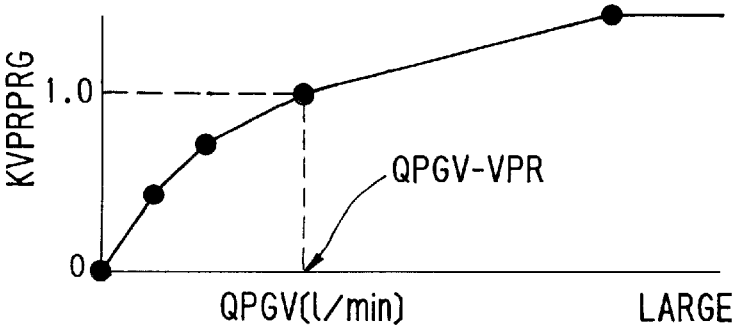
FIG. 10 is an explanatory graph showing the characteristics of a predetermined flow rate on which the characteristics of FIG. 9 are based.

Since the purged fuel vapor amount varies with the amount or concentration of fuel vapors stored in the canister (VPRCANI), even if the flow rate is constant, its characteristics are set with respect to the stored fuel vapor amount (concentration) VPRCANI as illustrated in FIG. 9. More precisely, the characteristics shown in FIG. 9 are based on the flow rate (the aforesaid predetermined flow rate) QPGV–VPR shown in FIG. 10.

The program then proceeds to S116 in which a correction coefficient KVPRPRGn is retrieved from table data (not shown) using the smoothed purge flow rate QPGV as the address datum. This coefficient is that for converting the calculated flow rate QPGV to the predetermined flow rate QPGV–VPR on which the FIG. 9 characteristics are based.

The program then proceeds to S118 in which it is determined whether a counter value CVPRCANI is zero, and when the result is affirmative, the program proceeds to S120 in which the counter value CVPRCANI is set to CVPRCAN0, then to S122 in which the current value of VPRCANIn is calculated as follows.

$$VPRCANIn=VPRCANI(n-1)-VPRPRGn\times KVPIPRGn\times CVPRCAN0/732$$

The above subtracts the decrease of the fuel vapor amount at current (control cycle) purge from the in-canister fuel vapor amount estimated up to the last (control cycle) VPRCANI(n–1). Since the purged amount is calculated in terms of a fuel vapor amount per minute, the value CVPRCAN0/732 is used to convert it into a value per control cycle (program loop).

Thus, the procedures in S118, S120, S122 are to determine the fuel vapor amount purged at this time (current control cycle) from the purged fuel vapor amount VPRPRGn and the correction coefficient KVPRPRGn so as to update the in-canister fuel vapor amount. When the result is negative in S118, the program skips S120 and S122.

The program then proceeds to S124 in which a learning control value KAFPG for compensating the air/fuel ratio variance is calculated. This is to calculate a parameter indicative of variance in the air/fuel ratios which would happen, not due to the canister purge, but due to any reason inherent to the engine fuel supply system. This is done under a condition free from the influence of canister purge when the air/fuel ratio is controlled to the stoichiometric air/fuel ratio. The value, thus obtained, is stored in a back-up up portion in the RAM of the ECU 34 so that the value is held after the engine has stopped.

Figure 11:
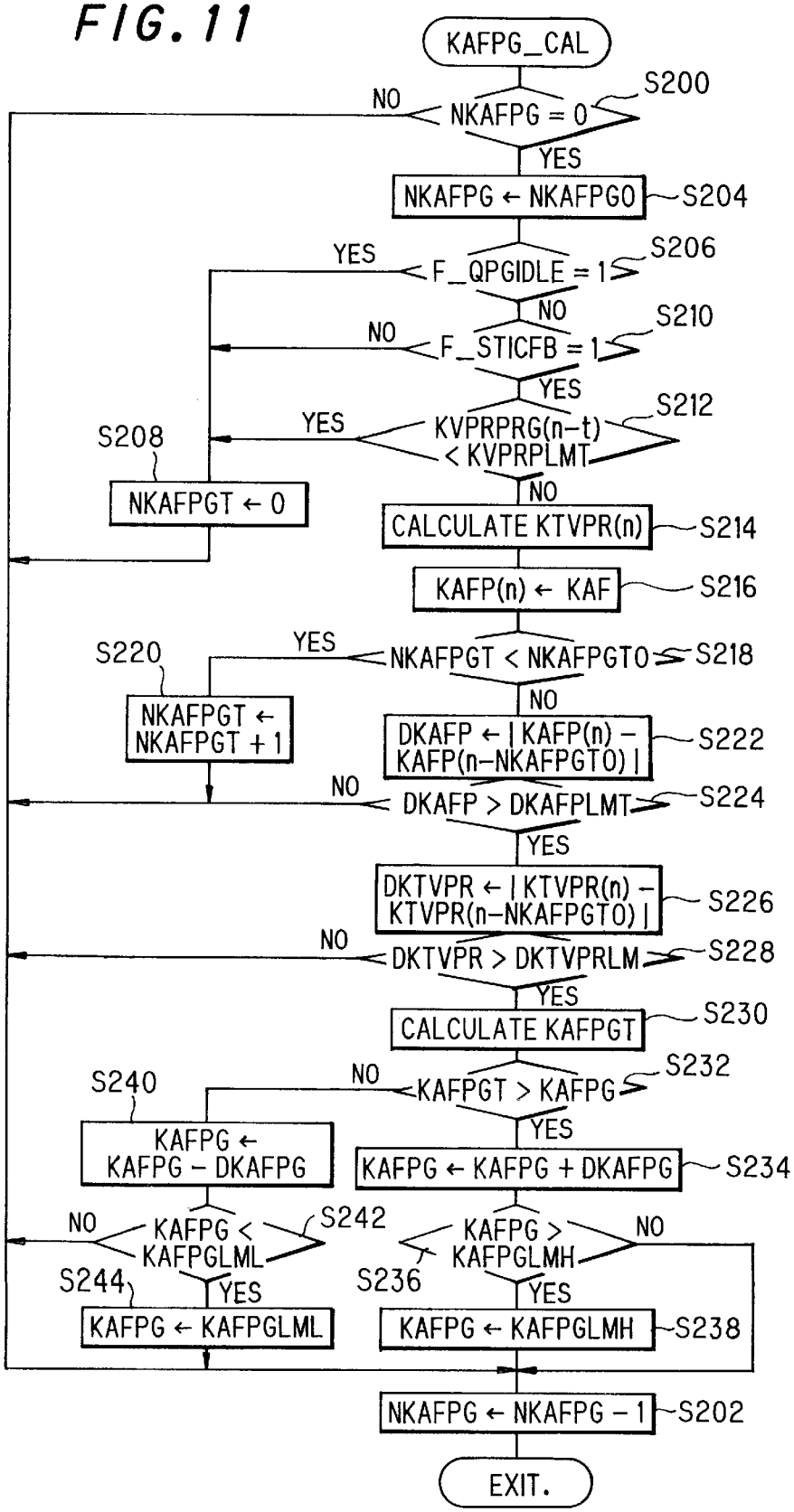
FIG. 11 is a flow chart showing the calculation of a learning control value of air/fuel ratio variance to be used in the calculation in the flow chart of FIG. 7.

FIG. 11 is a flow chart showing the subroutine for the leaning-control value for air/fuel ratio variance correction KAFPG.

The program starts in S200 in which it is determined whether a counter value NKAFPG is zero. When the result is negative, the program proceeds to S202 in which the counter value is decremented, whereafter the program is once terminated. When the result in S200 is affirmative in a next or later program loop, the program proceeds to S204 in which the counter is set with a value NKAFPG0, to S206 in which it is determined whether the bit of the flag F_QPGIDLE is 1.

When the result is affirmative indicating that the duty-ratio control should be carried out, the program proceeds to S208 in which a counter value NKAFPGT is reset to zero to discontinue the learning control so as not to be affected by the operational variance in the purge solenoid valve 225, then to S202 to terminate the program.

When the result in S206 is negative, on the other hand, since this means the flow rate control should be carried out, the program proceeds to S210 in which it is determined whether the bit of a flag F_STICFB is set to 1, more specifically it is determined whether the air/fuel ratio is feedback-controlled to the stoichiometric air/fuel ratio. When the result is negative, the program proceeds to S208.

When the result is affirmative, the program proceeds to S212 in which it is determined whether the flow rate correction coefficient KVPRPRG(n–t) is less than a predetermined value KVPRPLMT. This is done to prevent errors which would otherwise result from a division by a zero value. The time t is a value corresponding to the delay in purge flow rate and is calculating as follows using the aforesaid value NTVPR (TDC numbers for lag compensation).

$$t=NTVPR\times(366/NE).$$

When the result in S212 is affirmative, the program proceeds to S208. When the result is negative, the program proceeds to S214 in which a value KTVPR(n) is calculated as follows.

$$t=KTVPR(n)=(TiREQ\times NE)/KVPRPRG(n-t).$$

This value is an intermediate value to be used temporarily in the calculation of the leaning control value.

The program then proceeds to S216 in which the value of the aforesaid air/fuel ratio feedback correction coefficient KAF is assigned to a value KAFP(n). The program then proceeds to S218 in which it is determined whether the counter value NKAFPGT is less than a predetermined value NKAFPGT0. When the result is affirmative, the program proceeds to S220 in which the counter value is incremented, then to S202.

When the result in S218 is negative, the program proceeds to S222 in which a value DKAFP is calculated as the absolute value of the difference between the current value of KAFP(n) and the NKAFPGT0's earlier value KAFP(n–NKAFPGTO). The program then proceeds to S224 in which it is determined whether the obtained value DKAFP exceeds a predetermined value DKAFPLMT (a value corresponding to the steady-state error). When the result is negative, since this means that the error is little, the program proceeds to S202.

On the other hand, when the result in S224 is affirmative, since this means that the error is large, the program proceeds to S226 in which the value DKTVPR is calculated as the absolute value of the difference between the values of current time KTVPR(n) and that of NKAFPGT0's earlier value KTVPR(n–NKAFPGT0). The program then proceeds to S228 in which it is determined whether the calculated DKTVPR exceeds a predetermined value DKTVPRLM. When the result is negative, the program proceeds to S202.

On the other hand, when the result is affirmative, since this means that the error is large, the program proceeds to S230 in which the learning control value KAFPGT is calculated as follows.

$$KAFPGT=(KAFP(n)\times KTVPR(n)-KAFP(n-NKAFPGT0)\times KTVPR(n-NKAFPGT0)/(KTVPR(n)-KTVPR(n-NKAFPGT0)$$

The program then proceeds to S232 in which it is determined whether the calculated value KAFPGT exceeds the value KAFPG. When the result is affirmative, since this indicates that the air/fuel mixture is rich, the program proceeds to S234 in which the learning control value KAFPG is increased by the addition of a predetermined value DKAFPG. The program then proceeds to S236 in which it is determined whether the corrected learning control value KAFPG exceeds a upper limit KAFPGLMh and if it does, the program proceeds to S238 in which the learning control value is replaced by the upper limit value.

When the result in S232 is negative, since this means that the value calculated at this time indicates the air/fuel ratio is lean, the program proceeds to S240 in which the predetermined value DKAFPG is subtracted from the learning control value KAFPG to decrease the same, to S242 in which it is checked whether the corrected learning control value is less than a lower limit KAFPGLM and, if it is not, the program proceeds to S202. When the result in S242 is affirmative the program proceeds to S244 in which the learning control value is replaced by the lower limit. The program then proceeds to S202 in which the counter value NKAFPG is decremented.

Returning to the flow chart of FIG. 7, the program next proceeds to S126 in which the estimated in-canister fuel vapor amount VPRCANI is subjected to correction. Since it is impossible to directly measure the in-canister fuel vapor amount VPRCANI, the conditions of the air/fuel feedback control and the engine operation are monitored and the amount VPRCANI is corrected from the monitored states.

Figure 12:
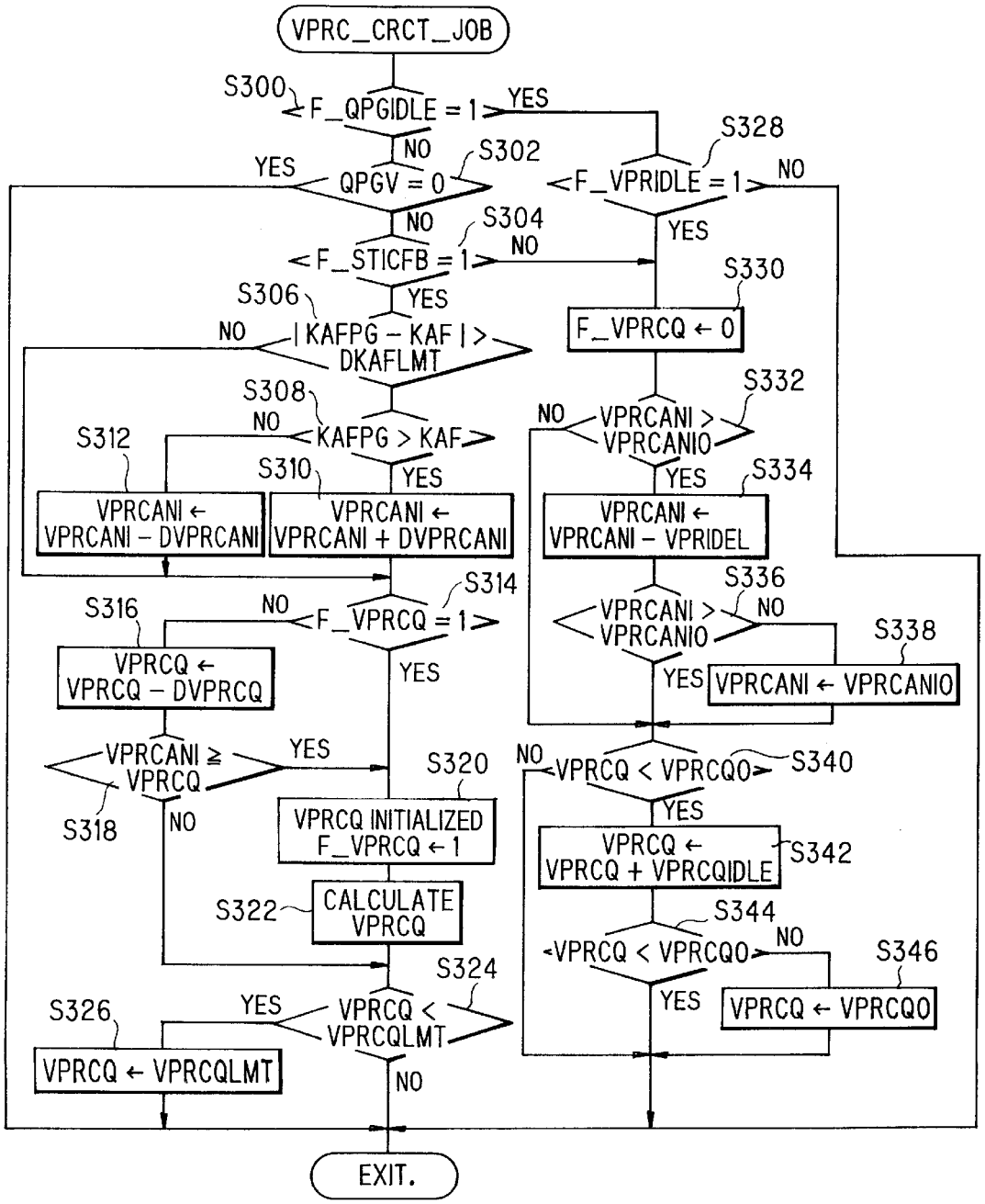
FIG. 12 is a flow chart showing the correction of the in-canister fuel vapor amount using the learning control value calculated in the flow chart of FIG. 11.

FIG. 12 is a flow chart showing the subroutine for the correction.

The program starts at S300 in which it is determined from the flag whether the duty-ratio control should be carried out and if not, the program proceeds to S302 in which it is determined whether the actual purge flow rate QPGV is zero. When the result is affirmative, since this means no canister purge is in progress, the program is immediately terminated.

When the result is negative, on the other hand, the program proceeds to S304 in which it is determined from the flag whether the air/fuel ratio is controlled to the stoichiometric air/fuel ratio. When the result is affirmative, the program proceeds to S306 in which the absolute value of the difference between the learning control value KAFPG and the air/fuel ratio feedback correction coefficient KAF is calculated and it is determined whether the calculated value exceeds a value DKAFLMT (indicating the air/fuel ratio variance due to the engine operating conditions).

Since the fuel supply system variance varies with the engine operating conditions (i.e., the engine speed NE, the manifold absolute pressure PBA, EGR implementation, etc.) and since the learning control value does not always indicate the variance at the current time, the variance should be taken into account.

When the result in S306 is affirmative, since this means that the error is large, the program proceeds to S308 in which it is determined whether the leaning control value KAFPG exceeds the coefficient KAF. When the result is affirmative, since this means that the estimated value VPRCANI deviates in the lean (lower) direction, the program proceeds to S310 in which a predetermined value DVPRCANI is added to VPRCANI to increase the latter.

When the result in S308 is negative, since this means that the value deviates in the rich (higher) direction, the program proceeds to S312 in which the predetermined value is subtracted from the value VPRCANI to decrease the same.

When the result in S306 is negative, since this means that the error is small and no correction is needed, the program skips S308, S310 and S312.

Figure 13:
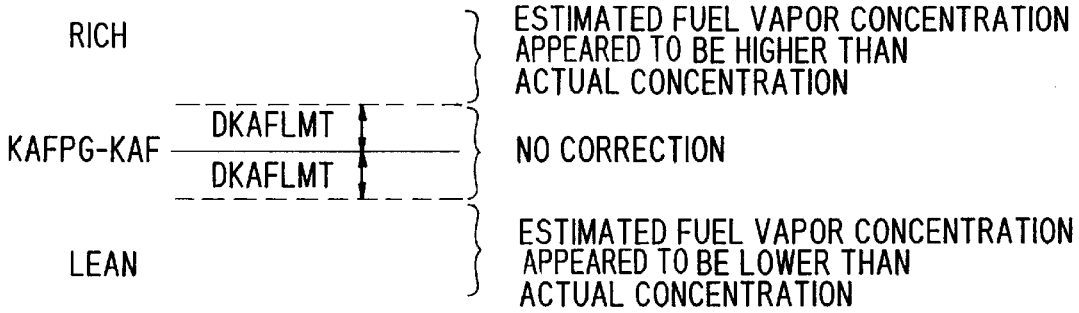
FIG. 13 is an explanatory view showing the procedures in the flow chart of FIG. 12 for correcting the in-canister fuel vapor amount by the learning control value.

As will be understood from FIG. 13, the range defined by adding or subtracting the predetermined value DKAFLMT to or from the difference is assumed to be the variance due to the engine operating conditions. The range is thus set as a blind zone.

The program then proceeds to S314 in which it is determined whether the bit of a flag F_VPRCQ is set to 1. Explaining this with reference to a time chart shown in FIG. 14, the value VPRCQ is an estimated value of a canister-absorbed fuel vapor amount used for calculating a desired purge flow rate. Since no fuel vapor amount has been estimated at the beginning of the canister purge and since it is difficult to use the aforesaid in-canister fuel vapor amount VPRCANI (used for fuel correction) as the initial value, this value is introduced for the desired purge flow rate calculation.

Figure 14:
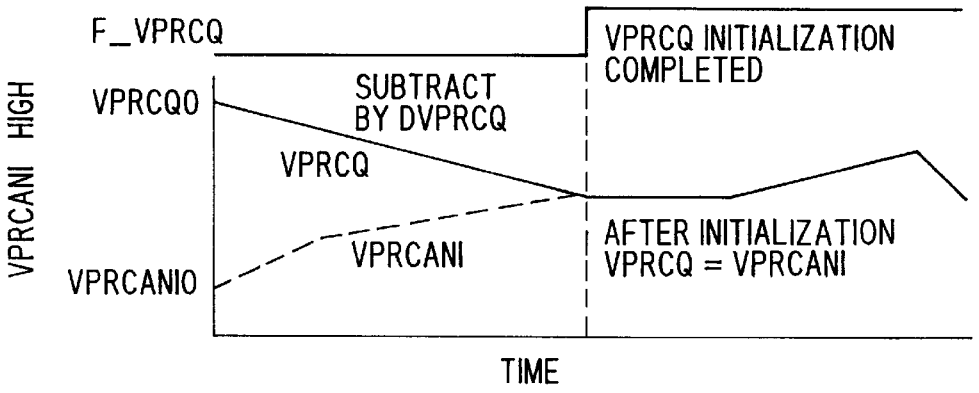
FIG. 14 is a time chart showing the initialization of the in-canister fuel vapor amount referred to in the flow chart of FIG. 12.

As illustrated in FIG. 14, the initial value of VPRCQ is set to VPRCQ0 at the initializing stage. To set the bit of the flag F_VPRCQ to 1 indicates that the initialization is completed.

Thus, when the result in S314 is negative, since this means that the state of the fuel vapors are uncertain, the program proceeds to S316 in which a predetermined value DVPRCQ is subtracted from VPRCQ to decrease the same so as to vary it up to the in-canister fuel vapor amount VPRCANI (used for fuel correction).

The program then proceeds to S318 in which it is determined whether VPRCANI is not less than the corrected VPRCQ, and if the result is affirmative, since this means that the initialization has been completed, the program proceeds to S320 in which the flag bit is set to 1, to S322 in which VPRCQ is calculated as follows.

$$VPRCQ = CVPRCQ \times VPRCANI + (1 - CVPRCQ) \times VPRCQ$$

Since the value VPRCQ plays a significant roll in calculating a basic value QPBBASE of the desired purge flow rate (explained later), the smoothing and limiting are thus conducted taking the calculation error of VPRCANI. This calculation is also conducted when the result in S314 is affirmative. When the result in S318 is negative, the program skips S320, S322.

The program then proceeds to S324 in which it is determined whether the calculated value VPRCQ is less than a limit VPRCQLMT and if it is, the program proceeds to S326 in which the value is replaced with the limit. This is because to take into account the purge flow rate change due to the estimated fuel vapors variances.

On the other hand, when the result in S300 is affirmative and indicates that the duty-ratio control should be carried out, the program proceeds to S328. It is difficult to determine the in-canister fuel vapor amount change accurately when the valve is duty-ratio controlled or the air/fuel ratio is not controlled to the stoichiometric air/fuel ratio. Since it could thus be difficult to carry out the purge control and fuel correction accurately when the engine operates under these conditions, the values VPRCANI, VPRCQ are restored gradually to their initial values, as explained below.

More specifically, it is determined in S328 whether the bit of a flag F_VPRIDLE is set to 1 and if not, the program is immediately terminated. When the result is affirmative, since this means that fuel vapors are present, the program proceeds to S330 in which the bit of the aforesaid flag F_VPRCQ is reset to 0. This step will be the same when the result in S304 is negative and indicates that the air/fuel ratio is not controlled to the stoichiometric air/fuel ratio.

The program then proceeds to S332 in which it is determined whether the estimated value VPRCANI exceeds its initial value VPRCANI0, and if it does, to S334 in which a predetermined value VPRIDLE is subtracted from the estimated value to decrease the same. The program next proceeds to S336 in which it is again determined whether the estimated value exceeds its initial value, and if not, to S338 in which the estimated value is replaced by its initial value.

When the result in S332 is negative, the program skips steps S334 through S338, and then proceeds to S340 through S346 in which similar procedures are taken for the value VPRCQ, as illustrated in FIG. 14, so as to return the value to its initial value VPRCQ0.

Again returning to the flow chart of FIG. 7, the counter value CVPRCANI is decremented and the program is terminated.

Based on the value thus determined, the purge solenoid valve 225 is controlled in such a manner that the purge flow rate become optimum in response to the fuel injection amount and the concentration of the fuel vapors.

Figure 15:
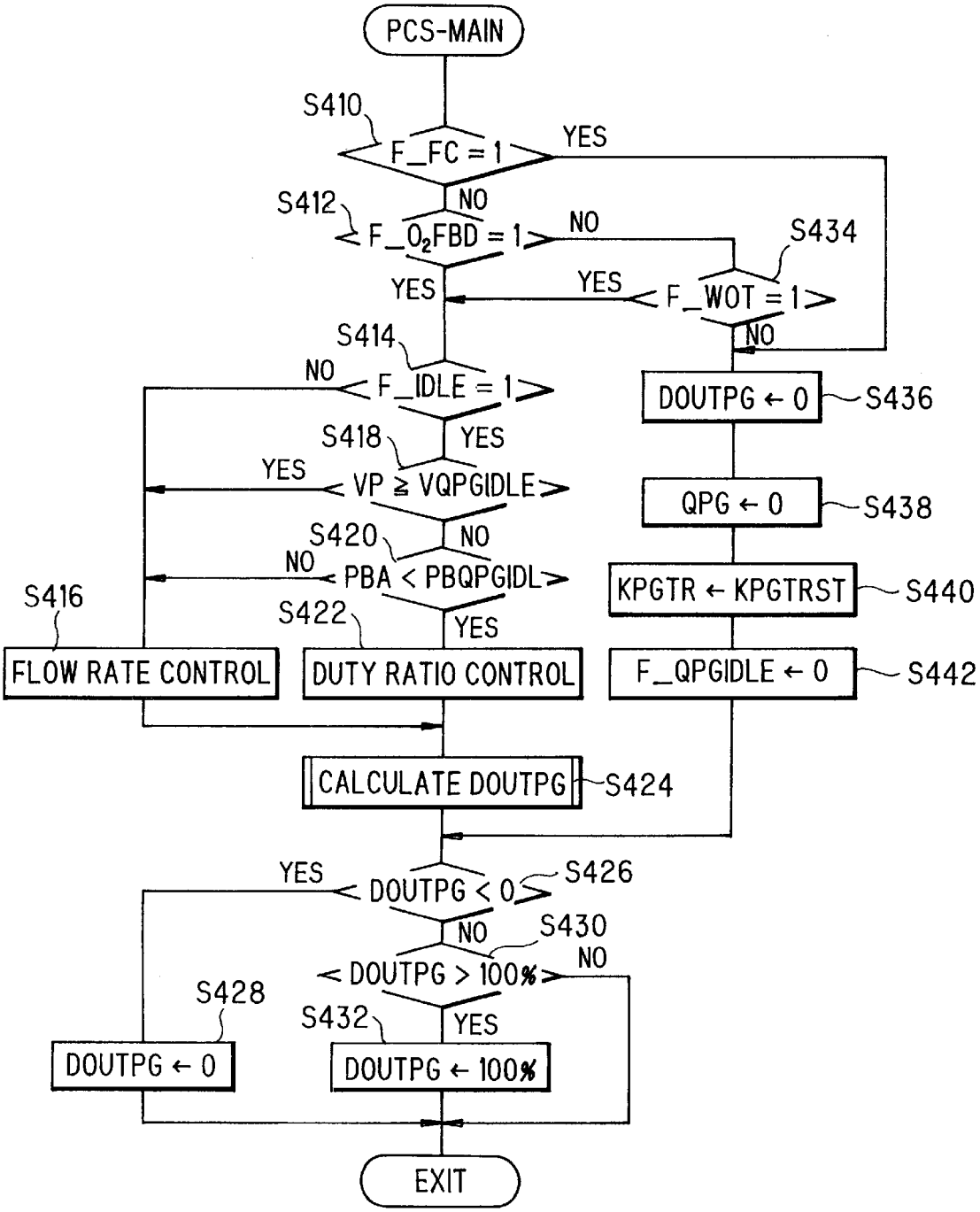
FIG. 15 is a flow chart showing the control of the purge solenoid valve of the canister purge mechanism shown in FIG. 2.

FIG. 15 is a main flow chart showing this control of the purge solenoid valve 225.

The program begins at S410 in which it is determined whether the fuel cutoff is in progress. When the result is negative, the program proceeds to S412 in which it is determined whether the air/fuel feedback control is in progress and if so, to S414 in which it is determined from the bit of a flag F_IDLE whether the engine is under idling state.

When the result is negative, the program proceeds to S416 in which the bit of a flag F_QPGIDLE is reset to zero indicating that valve is driven based on the flow rate control. When the result is affirmative, on the other hand, the program proceeds to S418 in which it is determined whether the detected vehicle speed VP is not less than a predetermined vehicle speed VQPGIDLE (an extremely low speed).

When the result is affirmative, the program proceeds to S416. When the result is negative, the program proceeds to S420 in which it is determined whether the detected manifold absolute pressure PBA is less than a predetermined pressure PBQPGIDL (a value corresponding to a low engine load). When the result is negative, the program proceeds to S416. When the result is affirmative, the program proceeds to S422 in which the flag bit is set to 1 indicating that the valve should be duty-ratio controlled. The program then proceeds to S424 in which the duty-ratio to be supplied to the solenoid 225*a* of the valve 225 is calculated.

Figure 16:
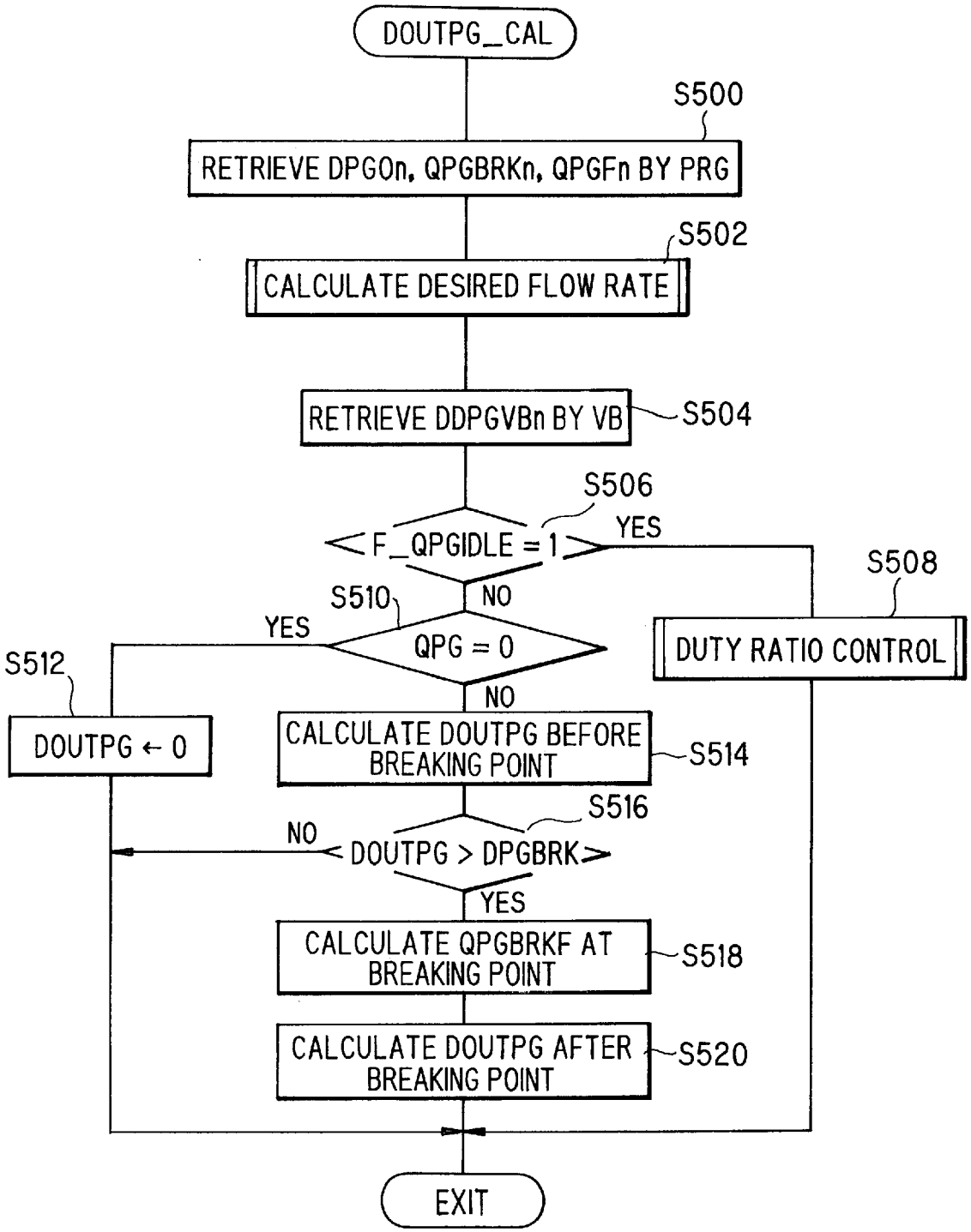
FIG. 16 is a flow chart showing the subroutine for calculating a duty ratio to be supplied to the solenoid of the purge solenoid valve referred to in the flow chart of FIG. 15.

FIG. 16 is a flow chart showing the subroutine for calculating the duty-ratio.

The program starts at S500 in which the pressure difference PBG between the detected atmospheric pressure PA and the manifold absolute pressure PBA is calculated and using the calculated pressure difference as the address datum, a value DPGOn is retrieved from table data.

Figure 17:
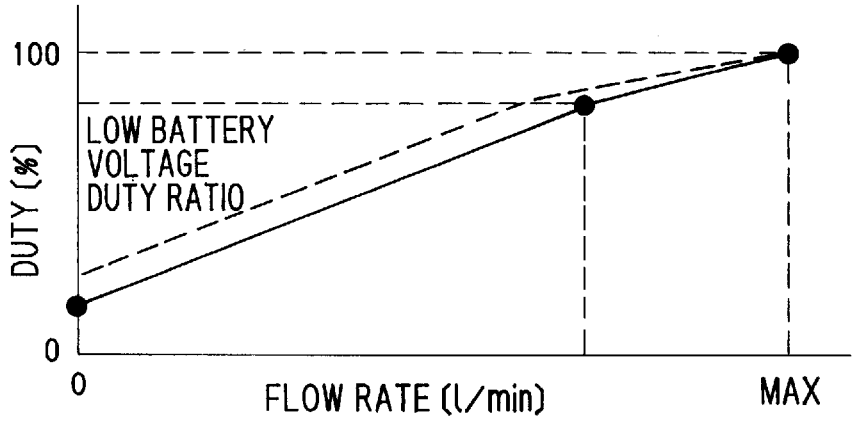
FIG. 17 is an explanatory graph showing the characteristics of the duty ratio relative to the purge flow rate referred to in the flow chart of FIG. 16.
Figure 18:
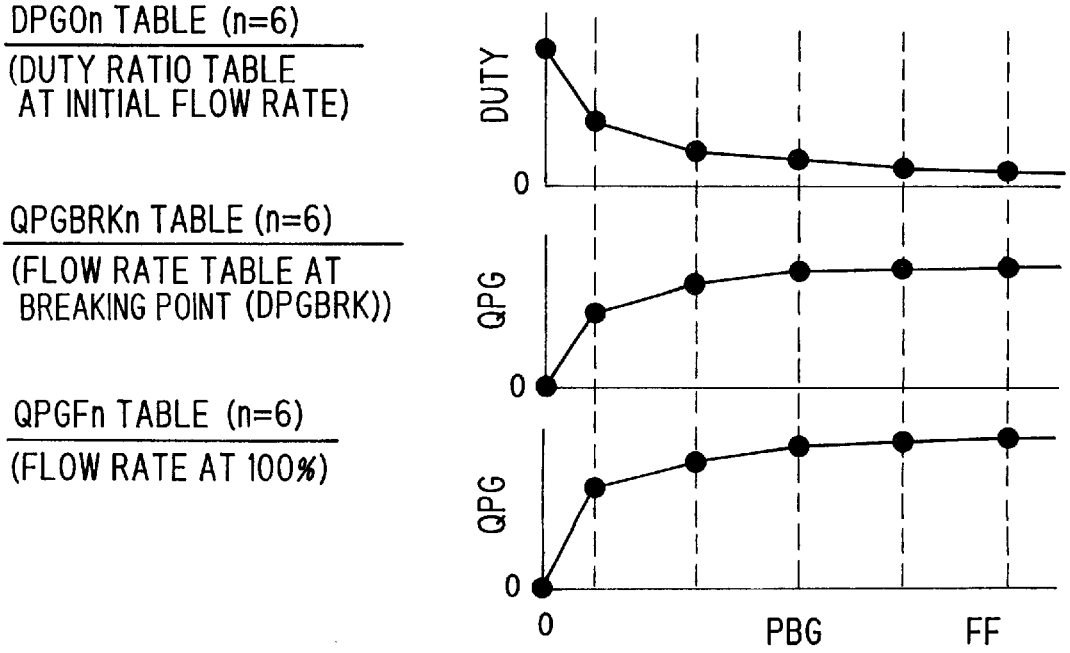
FIG. 18 is an explanatory graph showing the characteristic of FIG. 17 more specifically.

As illustrated in FIG. 17, the flow rate-duty ratio characteristics of the purge solenoid valve 225 used in this embodiment starts from not zero and breaks at a point. In this duty-ratio control, accordingly, the flow rate-duty ratio characteristics are divided into three, i.e., duty ratios from the initial flow rate to that at the breaking point, duty ratio to the flow rate at the breaking point and duty ratios to the flow rate alter the breaking point to its maximum (100%). The divided data are prepared in three table data shown in FIG. 18. In S500, all the three table data are retrieved using PBG.

The program then proceeds to S502 in which the desired flow rate QPG is calculated.

Figure 19:
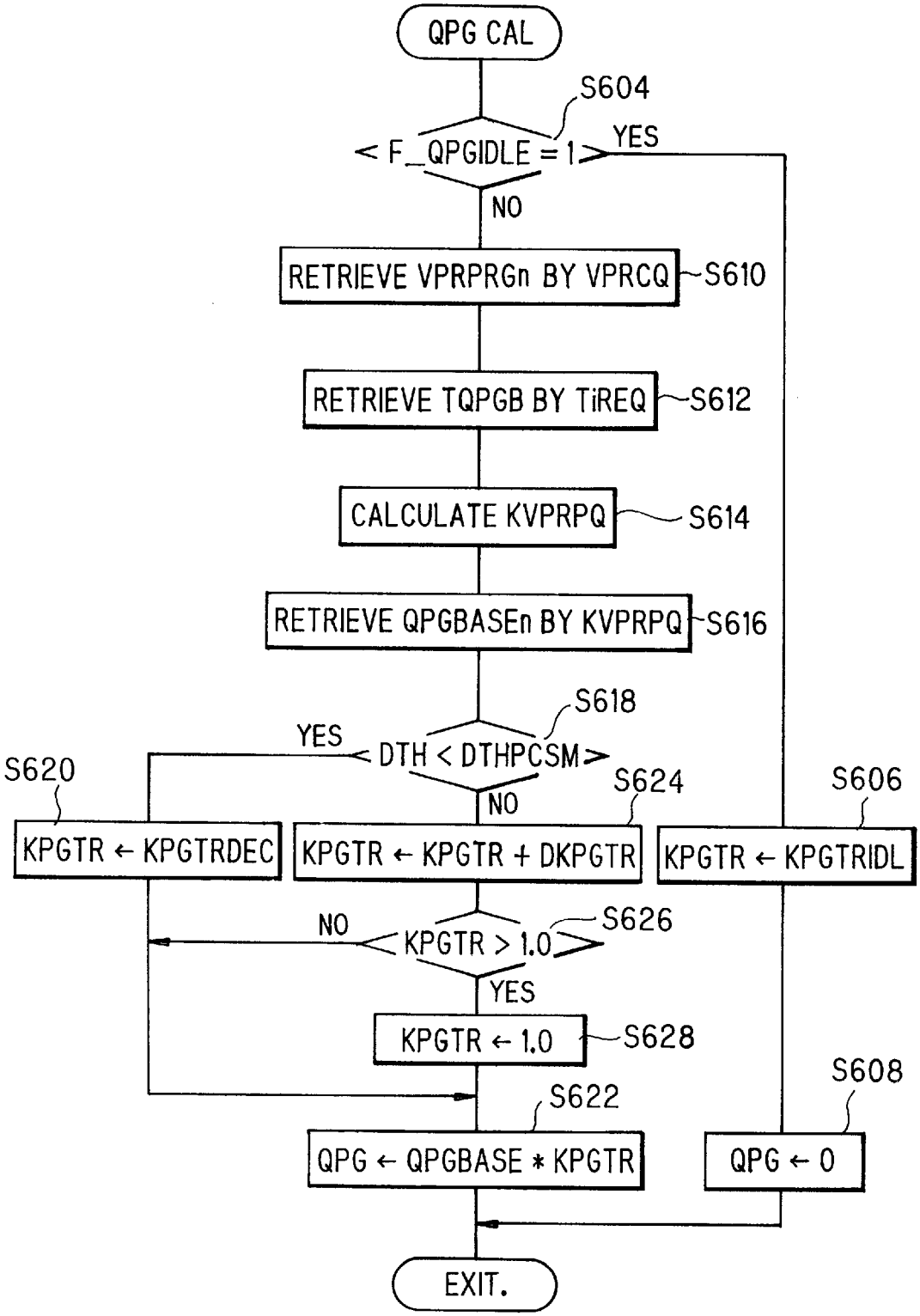
FIG. 19 is a flow chart showing the subroutine for calculating a desired flow rate referred to in the flow chart of FIG. 16.

FIG. 19 is a flow chart showing the subroutine for calculating the desired flow rate.

The program starts at S604 in which it is determined whether the bit of the aforesaid flag is set to 1. If the result is affirmative, since this means that the purge solenoid valve 225 should be duty-ratio controlled, the program proceeds to S606 in which a correction coefficient is set to a predetermined value KPGTRIDL, to S608 in which the desired flow rate QPG is set to zero, since no flow rate control should be carried out, and the program is terminated.

Figure 20:
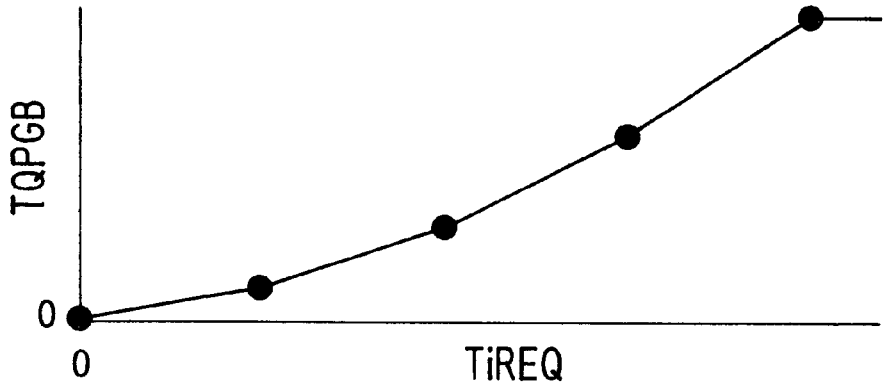
FIG. 20 is an explanatory graph showing the characteristics of table data referred to in the flow chart of FIG. 19.

On the other hand, when the result in S604 is negative, since this means that the flow rate control should be carried out, the program proceeds to S610 in which the value VPRPRGn is retrieved from table data (not shown, but similar to those illustrated in FIG. 9). The program then proceeds to S612 in which the desired fuel vapor amount to be purged TQPGB is retrieved from table data (whose characteristics are shown in FIG. 20) using the aforesaid fuel injection amount TiREQ as the address datum.

The program then proceeds to S614 in which a purge flow rate coefficient KVPRPQ is calculated. To be more specific, it is calculated as follows using the desired fuel vapors to be purged TQPGB, the in-canister-absorbed fuel vapor amount VPRPRGQ, etc.

$$KVPRPQ=(2\times NE\times TQPGB)/(KVPR2TI\times VPRPRGQ)$$

Figure 21:
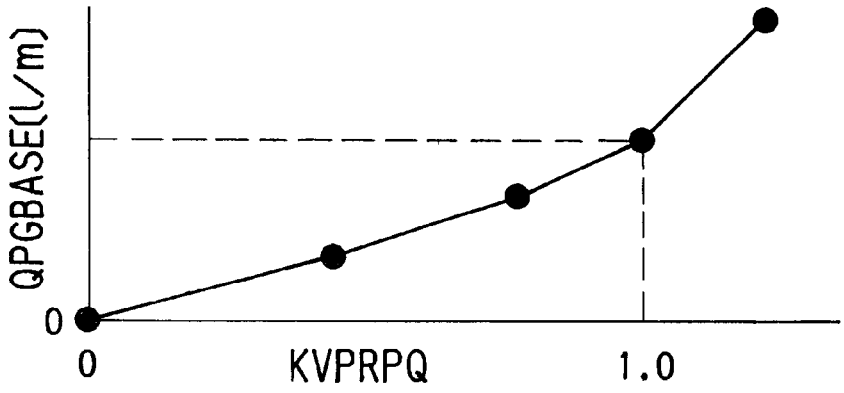
FIG. 21 is an explanatory graph showing the characteristics of other table data referred to in the flow chart of FIG. 19.

The program then proceeds to S616 in which the basic value QPGBASEn of the desired purge flow rate is retrieved from table data (whose characteristics are illustrated in FIG. 21) using the calculated value KVPRPQ as the address datum. The program then proceeds to S618 in which the throttle opening change DTH is calculated and it is determined whether it is less than a predetermined value DTHPCSM.

When the result is affirmative, it is considered that the throttle opening changes greatly in the decelerate direction, and the program accordingly proceeds to S620 in which a correction coefficient KPGTR is determined to be a value KPGTRDEC at deceleration, to S622 in which the basic value QPGBASE is multiplied by the value KPGTR and the calculated value is inserted as the desired flow rate QPG.

When the result in S618 is negative, the program proceeds to S624 in which the correction coefficient KPGTR is increased by the addition of a predetermined value DKPGTR. The program then proceeds to S626 and S628 in which the correction coefficient is limited (set) to 1.0 when it exceeds 1.0, and to S622 in which the desired flow rate is calculated in the manner explained above.

Returning to the flow chart of FIG. 16, the program next proceeds to S504 in which a battery-voltage correction coefficient DDPGVBn is, retrieved from table data using the detected battery voltage VB as the address datum. The program then proceeds to S506 in which it is determined whether the bit of the aforesaid flag F_QPIDLE is set to 1 and, if the result is affirmative, to S508 in which the duty-ratio control is conducted.

Figure 22:
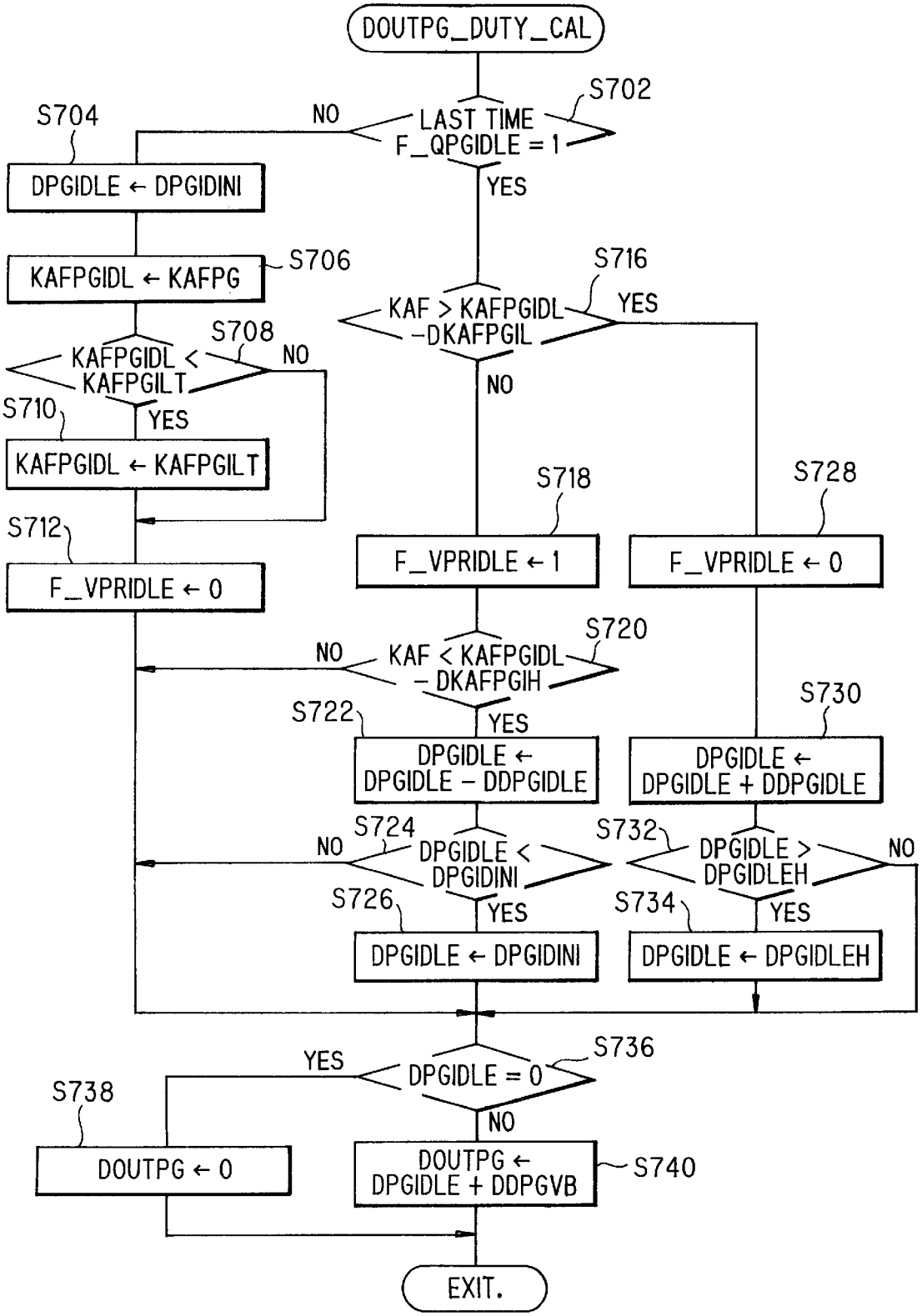
FIG. 22 is a flow chart showing the subroutine for duty-ratio controlling the purge solenoid valve referred to in the flow chart of FIG. 16.

FIG. 22 is a flow chart showing the subroutine for conducting the duty-ratio control.

Figure 23:
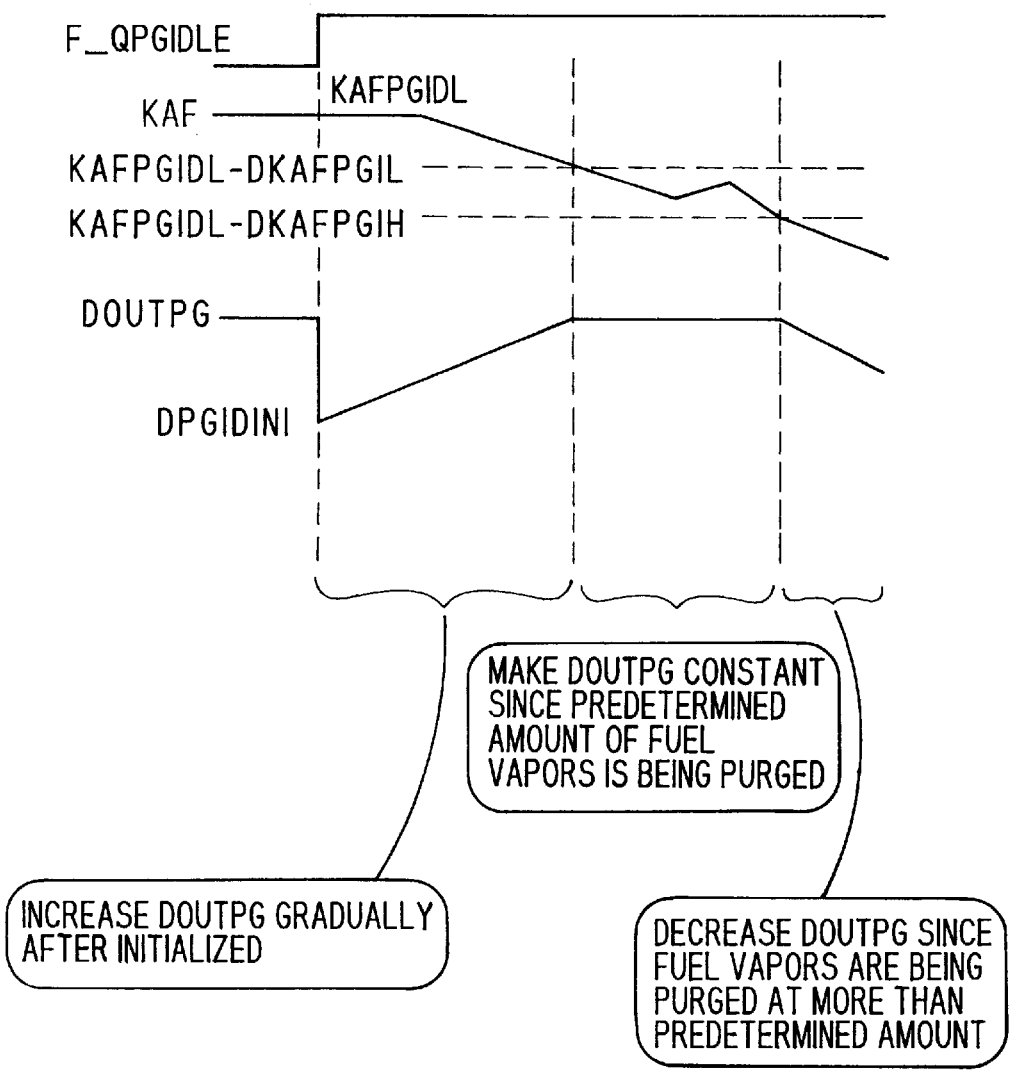
FIG. 23 is an explanatory time chart showing the operation of the procedures shown in the flow chart of FIG. 22.

The program starts at S702 in which it is determined whether the bit of the flag QPGIDLE was set to 1 in the last time (control cycle). If the result is negative, since this means that the flow rate control was conducted in the last time, the program proceeds to S704 in which a value DPGIDLE is rewritten using value DPGIDINI. FIG. 23 time chart illustrates the procedures of the flow chart of FIG. 22.

The value DPGIDINI and DPGIDLEH (explained later) are set such that the purge can be carried out at engine idling even when the operation of the purge solenoid valve 225 diverges. Specifically, they are set such that DPGIDINI defines the initial duty ratio of the purge solenoid valve 225 if its operation diverges to the direction in which the flow rate increases, while DPGIDLEH defines the duty ratio which effects the desired flow rate at engine idling if the valve operation diverges to the opposite direction in which the flow rate decreases.

The program then proceeds to S706 in which the aforesaid learning control value KAFPG is renamed as KAFPGIDL. Since the purge effects greatly under engine idling, the flow rate control is carried out monitoring the conditions in the air/fuel ratio control.

The program then proceeds to S708 in which it is determined whether the rewritten value KAFPGIDL is less than a predetermined value KAFPGILT and if so, the program proceeds to S710 to replace KAFPGIDL is replaced by KAFPGILT. When the result is negative, the program skips S710.

The program then proceeds to S712 in which the bit of a flag F_VPRIDLE is reset to 0. The flag bit is set to 1 if the state of the fuel vapors are considered to be uncertain. The state of the fuel vapors are deemed to be uncertain when fuel vapors are being purged or fuel vapors are leaving the fuel tank 36. Thus, while the state of fuel vapors is changing, but not possible to determine, the state of fuel vapors are considered to be uncertain. In such instance, the estimated value VPRCANI is gradually restored to its initial value in response to the degree of uncertainty.

When the result in S702 is affirmative, on the other hand, the program proceeds to S716 in which it is determined whether the coefficient KAF exceeds the difference obtained by subtracting the value DKAFPGIL from the value KAFPGIDL. When the result is negative, it is considered that the effect on the air/fuel ratio would be great so that the program proceeds to S718 in which the flag bit is set to 1,to S720 in which it is determined that KAF is less than the difference obtained by subtracting DKAFPGIH from KAFPGIDL.

When the result in S720 is affirmative, it is similarly considered that the effect on the air/fuel ratio would be great so that the program proceeds to S722 in which a fine amount DDPGIDLE is subtracted from the value DPGIDLE to decrease the same, to S724 in which it is determined that the decreased value DPGIDLE is less than the aforesaid value DPGIDINI. When the result is affirmative, the program proceeds to S726 in which DPGIDLE is replaced by DPOIDINI.

When the result in S716 is affirmative, it is considered that the effect on the air/fuel ratio is little, so that the program proceeds to S728 in which the flag bit is reset to 0, to S730 in which the fine amount DDPGIDLE is added to the value DPGIDLE to increase the same, to S732 in which it is determined whether the increased value DPGIDLE exceeds the aforesaid value DPGIDLEH and if so, to S734 in which DPGIDLE is replaced by DPGIDLEH.

The program then proceeds to S736 in which it is determined whether DPGIDLE, thus obtained, is zero. When the result is affirmative, the program proceeds to S738 in which the duty ratio DOUTPG is determined to be zero. When the result is negative, the program proceeds to S740 in which the value DPGIDLE is added by a predetermined value DDPGVB and the sum value is assigned to the duty ratio value DOUTPG. When the result in negative in S720 or S724 or S732, the program jump to S736.

Returning to the flow chart of FIG. 16, when the result in S506 is negative, since this means that the flow rate control is conducted, the program proceeds to S510 in which it is determined whether the desired flow rate QPG is zero. When the result is affirmative, since this means that no canister purge is in effect, the program proceeds to S512 in which the duty ratio DOUTPG is set to zero.

When the result in S510 is negative, the program proceeds to S514 in which the desired flow rate QPG is converted into the duty ratio DOUTPG using the characteristics before the breaking point. More specifically, it is calculated as follows.

$$DOUTPG=[(DPGBRK-DPGOn)/QPGBRKn]\times QPG+DPGOn+DDPGVB$$

The program then proceeds to S516 in which it is determined whether the duty ratio DOUTPG exceeds DPGBRK, in other words it exceeds the breaking point. If the result is negative, the program is terminated. If the result is affirmative, on the other hand, the program proceeds to S518 in which the flow rate at the breaking point QPGBRKF is calculated. Since the valve variance varies with the voltage, this is calculated as follows.

$$QPGBRKF=QPGBRKn-[DDPGVB/(DPGBRK-DPGOn)]\times QPGBRKn$$

The program next proceeds to S520 in which similar conversion is carried out using the characteristics after the breaking point as follows.

$$DOUTPG=[(100\%-DPGBRK]/((QPGFn-QPGBRKF)]\times(QPG-QPBRKF)+DPGBRK$$

Returning to the flow chart of FIG. 15, the program then proceeds to S426 in which it is determined whether the duty ratio is less than zero. When the result is affirmative, the program proceeds to S428 in which the duty ratio is rewritten as zero. When the result is negative, the program proceeds to S430 in which it is determined whether the duty ratio DOUTPG is 100% and if so, to S432 in which the duty ratio is rewritten as 100%.

When the result in S412 is negative, the program proceeds to S434 in which it is determined whether the bit of a flag F_WOT is equal to 1, in other words, it is determined whether the throttle valve is fully opened. When the result is affirmative, the program proceeds to S414. When the result is negative, the program proceeds to S436 in which the duty ratio is set to zero.

The program then proceeds to S438 in which the desired flow rate QPG is set to zero, to S440 in which the aforesaid value KPGTR is rewritten as KPGTRST. This step is to restore the purge flow rate gradually in order that the fuel correction can be immediately conducted when returning from a special mode to a normal mode. The program then proceeds to S442 in which the bit of the flag F_QPGIDLE is set to zero, and to S426.

The fuel injection amount will then be corrected by the correctional purged fuel amount thus determined in accordance with the procedures described with reference to the flow chart of FIG. 3.

The embodiment is thus configured to have a system for controlling fuel vapors of an internal combustion engine 10 having a fuel supply system including a fuel tank for supplying fuel to an air intake system (air intake pipe 12 or intake manifold 20) such that an air-fuel mixture flows to a combustion chamber, comprising fuel vapor storing means (charcoal canister 223) for storing fuel vapors vaporized in the fuel supply system; purge means (ECU34) for purging the stored fuel vapors into the air intake system of the engine through a purge line 224; a valve (purge solenoid valve 225) provided in the purge line for opening or closing the purge line; fuel vapor amount estimating means (ECU 34, S118–S128) for estimating an amount of the fuel vapors (VPRCANI, TVPRPRG) stored in the fuel vapor storing means; flow rate calculating means (ECU 34, S100–S116) for calculating a flow rate of fuel vapors QPGV purged to the air intake system through the valve; purged fuel amount calculating means (ECU 34, S26, S50–S78) for calculating a (correctional) purged fuel amount TiEVAP supplied to the intake system of the engine; basic fuel injection amount calculating means (ECU 34, S16–S24) for calculating a basic fuel injection amount TiM in response to detected engine operating parameters (NE, PBA); fuel injection amount calculating means (ECU 34, S28–S30) for calculating a fuel injection amount Tout to be supplied to the engine based on the calculated purged fuel amount and the basic fuel injection amount; and an injector 22 for injecting fuel into the air intake system in response to the calculated fuel injection amount; wherein said purged fuel amount calculating means calculates the purged fuel amount based on the estimated amount of the fuel vapors in response to a transport delay of the purged fuel vapors (ECU 34, S66–S74).

The system is configured such that said purged fuel amount calculating means calculates the purged fuel amount in response to a lag of combustion cycles NTVPR before the purged fuel vapors enter the combustion chamber.

The system is configured such that said purged fuel amount calculating means includes combustion cycle lag retrieving means (ECU 34, S68) for retrieving the combustion cycle lag by a detected engine speed NE; wherein said purged fuel amount calculating means calculates the purged fuel amount based on the estimated amount of the fuel vapors TVPRPRG in response to the lag of combustion cycles.

The system is configured such that said purged fuel amount calculating means calculates the purged fuel amount based on the estimated amount of the fuel vapors and the calculated flow rate.

The system is configured such that said purged fuel amount calculating means includes: delay time retrieving means (ECU 34, S68) for retrieving a delay time NTVPR indicative of the transport delay by a detected engine speed NE; and value determining means for determining the estimated amount of the fuel vapors corresponding to the delay time (n−NTVPR); wherein said purged fuel amount calculating means calculates the purged fuel amount based on the estimated amount of the fuel vapors corresponding to the delay time and the calculated flow rate.

The system is also configured to include an air/fuel ratio sensor ($O_2$ sensor 56) for outputting a signal indicative of oxygen concentration in exhaust gas generated by the engine; air/fuel ratio feedback coefficient calculating means (ECU 34, S24) for calculating an air/fuel ratio feedback correction coefficient KAF to feedback-control the air/fuel ratio to a desired value; air/fuel ratio variance learning control means (ECU 34, S200–S234) for calculating a learning control value KAFPG inherent to the engine based on the air/fuel ratio feedback correction coefficient; wherein said purged fuel vapor amount calculating means calculates the purged fuel amount based on the estimated amount of the fuel vapors in response to the air/fuel ratio feedback correction coefficient and the learning control value.

The system is configured such that said purged fuel amount calculating means includes difference calculating means (ECU34, S306) for calculating a difference (KAFPG−KAF) between the air/fuel ratio feedback correction coefficient and the learning control value; wherein said purged fuel amount calculating means calculates the purged fuel amount in response to the difference.

The system is configured such that said purged fuel amount calculating means includes: determining means (ECU 34, S306) for determining whether the difference exceeds the predetermined value DKAFLMT; comparing means (ECU 34, S308) for comparing the air/fuel ratio feedback correction coefficient with the learning control value when the difference is determined to exceed the predetermined value; and correcting means (ECU 34, S310, S312) for correcting the estimated amount of the fuel vapors in response to a result of the comparison; wherein said purged fuel amount calculating means calculates the purged fuel amount based on the corrected estimated amount of the fuel vapors.

It should be noted in the above that, although the air/fuel ratio feedback correction coefficient KAF and the learning control value KAFPG are immediately used, it is alternatively possible to calculate an average value thereof to be used.

It should also be noted that, although the $O_2$ sensor is used as the air/fuel ratio sensor, it is alternatively possible to use another air/fuel ratio sensor which produces a linear signal indicative of the oxygen concentration.

Although the invention has thus been shown and described with reference to specific embodiments, it should be noted that the invention is in no way limited to the details of the described arrangements, but changes and modifications may be made without departing from the scope of the invention, which is defined by the appended claims.

What is claimed is:

1. A system for controlling fuel vapors of an internal combustion engine having a fuel supply system including a fuel tank for supplying fuel to an air intake, system such that an air-fuel mixture flows to a combustion chamber, comprising fuel vapor storing means for storing fuel vapors vaporized in the fuel supply system;

purge means for purging the stored fuel vapors into the air intake system of the engine through a purge line;

a valve provided in the purge line for opening or closing the purge line;

fuel vapor amount estimating means for estimating an amount of the fuel vapors stored in the fuel vapor storing means;

flow rate calculating means for calculating a flow rate of fuel vapors purged to the air intake system through the valve;

purged fuel amount calculating means for calculating a purged fuel amount supplied to the intake system of the engine;

basic fuel injection amount calculating means for calculating a basic fuel injection amount in response to detected engine operating parameters;

fuel injection amount calculating means for calculating a fuel injection amount to be supplied to the engine based on the calculated purged fuel amount and the basic fuel injection amount; and an injector for injecting fuel into the air intake system in response to the calculated fuel injection amount;

wherein:

said purged fuel amount calculating means calculates the purged fuel amount based on the estimated amount of the fuel vapors in response to a transport delay of the purged fuel vapors.

2. A system according to claim 1, wherein said purged fuel amount calculating means calculates the purged fuel amount in response to a lag of combustion cycles before the purged fuel vapors enter the combustion chamber.

3. A system according to claim 2, wherein said purged fuel amount calculating means includes:

combustion cycle lag retrieving means for retrieving the lag of combustion cycles by a detected engine speed; and wherein said purged fuel amount calculating means calculates the purged fuel amount based on the estimated amount of the fuel vapors in response to the lag of combustion cycles.

4. A system according to claim 1, wherein said purged fuel amount calculating means calculates the purged fuel amount based on the estimated amount of the fuel vapors and the calculated flow rate.

5. A system according to claim 4, wherein said purged fuel amount calculating means includes:

delay time retrieving means for retrieving a delay time indicative of the transport delay by a detected engine speed; and value determining means for determining the estimated amount of the fuel vapors corresponding to the delay time;

wherein said purged fuel amount calculating means calculates the purged fuel amount based on the estimated amount of the fuel vapors corresponding to the delay time and the calculated flow rate.

6. A system for controlling fuel vapors of an internal combustion engine having a fuel supply system including a fuel tank for supplying fuel to an air intake system such that an air-fuel mixture flows to a combustion chamber, comprising:

fuel vapor storing means for storing fuel vapors vaporized in the fuel supply system;

purge means for purging the stored fuel vapors into the air intake system of the engine through a purge line;

a valve provided in the purge line for opening or closing the purge line;

fuel vapor amount estimating means for estimating an amount of the fuel vapors stored in the fuel vapor storing means;

flow rate calculating means for calculating flow rate of fuel vapors purged to the air intake system through the valve;

purged fuel amount calculating means for calculating a purged fuel amount supplied to the intake system of the engine;

basic fuel injection amount calculating means for calculating a basic fuel injection amount in response to detected engine operating parameters;

fuel injection amount calculating means for calculating a fuel injection amount to be supplied to the engine based on the calculated purged fuel amount and the basic fuel injection amount; and an injector for injecting fuel into the air intake system in response to the calculated fuel injection amount;

wherein said system further includes:

an air/fuel ratio sensor for outputting a signal indicative of oxygen concentration in exhaust gas generated by the engine;

air/fuel ratio feedback coefficient calculating means for calculating an air/fuel ratio feedback correction coefficient to feedback-control the air/fuel ratio to a desired value;

air/fuel ratio variance learning control means for calculating a learning control value inherent to the engine based on the air/fuel ratio feedback correction coefficient; and wherein said purged fuel vapor amount calculating means calculates the purged fuel amount based on the estimated amount of the fuel vapors in responses to the air/fuel ratio feedback correction coefficient and the learning control value.

7. A system according to claim 6, wherein said purged fuel amount calculating means includes:

difference calculating means for calculating a difference between the air/fuel ratio feedback correction coefficient and the learning control value;

wherein said purged fuel amount calculating means calculates the purged fuel amount in response to the difference.

8. A system according to claim 7, wherein said purged fuel amount calculating means includes:

determining means for determining whether the difference exceeds the predetermined value;

comparing means for comparing the air/fuel ratio feedback correction coefficient with the learning control value when the difference is determined to exceed the predetermined value; and correcting means for correcting the estimated amount of the fuel vapors in response to a result of the comparison;

wherein said purged fuel amount calculating means calculates the purged fuel amount based on the corrected estimated amount of the fuel vapors.

9. A method of controlling fuel vapors of an internal combustion engine having a fuel supply system including a fuel tank for supplying fuel to an air intake system such that an air-fuel mixture flows to a combustion chamber, including:

a fuel vapor storing means for storing fuel vapors vaporized in the fuel supply system;

a purge means for purging the stored fuel vapors into the air intake system of the engine through a purge line;

a valve provided in the purge line for opening or closing the purge line;

a fuel vapor amount estimating means for estimating an amount of the fuel vapors stored in the fuel vapor storing means;

a flow rate calculating means for calculating flow rate of fuel vapors purged to the air intake system through the valve;

a purged fuel amount calculating means for calculating a purged fuel amount supplied to the intake system of the engine;

a basic fuel injection amount calculating means for calculating a basic fuel injection amount in response to detected engine operating parameters;

a fuel injection amount calculating means for calculating a fuel injection amount to be supplied to the engine based on the calculated purged fuel amount and the basic fuel injection amount; and an injector for injecting fuel into the air intake system in response to the calculated fuel injection amount;

wherein the improvement comprises the step of:

calculating the purged fuel amount based on the estimated amount of the fuel vapors in response to a transport delay of the purged fuel vapors.

10. A method according to claim 9, wherein the purged fuel amount is calculated in response to a lag of combustion cycles before the purged fuel vapors enter the combustion chamber.

11. A method according to claim 10, further including the steps of:

retrieving the lag of combustion cycles by a detected engine speed; and calculating the purged fuel amount based on the estimated amount of the fuel vapors in response to the retrieved lag of combustion cycles.

12. A method according to claim 9, wherein the purged fuel amount is calculated based on the estimated amount of the fuel vapors and the calculated flow rate.

13. A method according to claim 12, further including the steps of:

retrieving a delay time indicative of the transport delay by a detected engine speed; and determining the estimated amount of the fuel vapors corresponding to the delay time; and calculating the purged fuel amount based on the estimated amount of the fuel vapors corresponding to the delay time and the calculated flow rate.

14. A method of controlling fuel vapors of an internal combustion engine having a fuel supply system including a fuel tank for supplying fuel to an air intake system such that an air-fuel mixture flows to a combustion chamber, including fuel vapor storing means for storing fuel vapors vaporized in the fuel supply system;

purge means for purging the stored fuel vapors into the air intake system of the engine through a purge line;

a valve provided in the purge line for opening or closing the purge line;

fuel vapor amount estimating means for estimating an amount of the fuel vapors stored in the fuel vapor storing means;

flow rate calculating means for calculating flow rate of fuel vapors purged to the air intake system through the valve;

purged fuel amount calculating means for calculating a purged fuel amount supplied to the intake system of the engine;

basic fuel injection amount calculating means for calculating a basic fuel injection amount in response to detected engine operating parameters;

fuel injection amount calculating means for calculating a fuel injection amount to be supplied to the engine based on the calculated purged fuel amount and the basic fuel injection amount; and an injector for injecting fuel into the air intake system in response to the calculated fuel injection amount;

wherein the improvement comprises the steps of:

calculating an air/fuel ratio feedback correction coefficient based on a detected air/fuel ratio to feedback-control the air/fuel to a desired value;

calculating a learning control value inherent to the engine based on the air/fuel ratio feedback correction coefficient; and calculating the purged fuel amount based on the estimated amount of the fuel vapors in response to the air/fuel ratio feedback correction coefficient and the learning control value.

15. A method according to claim 14, further including the steps of:

calculating a difference between the air/fuel ratio feedback correction coefficient and the learning control value; and calculating the purged fuel amount in response to the difference.

16. A method according to claim 15, further including the steps of:

determining whether the difference exceeds the predetermined value;

comparing the air/fuel ratio feedback correction coefficient with the learning control value when the difference is determined to exceed the predetermined value; and correcting the estimated amount of the fuel vapors in response to a result of the comparison; and calculating the purged fuel amount based on the corrected estimated amount of the fuel vapors.

* * * * *